US005871894A

United States Patent [19]

Takahashi et al.

[11] Patent Number: 5,871,894

[45] **Date of Patent: *Feb. 16, 1999**

[54] SILVER HALIDE COLOR PHOTOGRAPHIC LIGHT-SENSITIVE MATERIAL

[75] Inventors: Osamu Takahashi; Hidekazu Sakai; Junichi Yamanouchi; Masashi Ogiyama, all of Minami-ashigara, Japan

[73] Assignee: Fuji Photo Film Co., Ltd., Minami-ashigara, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 728,357

[22] Filed: Oct. 9, 1996

[30] Foreign Application Priority Data

Oct. 16, 1995 [JP] Japan ..... 7-293687

[51] Int. Cl.[6] ..... G03C 1/053; G03C 7/34; G03C 7/396

[52] U.S. Cl. ..... 430/538; 430/545; 430/627; 430/628

[58] Field of Search ..... 430/627, 545, 430/628, 538

[56] References Cited

U.S. PATENT DOCUMENTS

| | | | |
|---|---|---|---|
| 2,816,028 | 12/1957 | Minsk et al. | 430/627 |
| 3,619,195 | 11/1971 | Van Campen | 96/100 |
| 4,368,258 | 1/1983 | Fujiwhara et al. | 430/627 |
| 4,374,922 | 2/1983 | Ohbayashi et al. | 430/383 |
| 4,591,548 | 5/1986 | Delprato | 430/553 |
| 4,677,050 | 6/1987 | Yokoyama et al. | 430/634 |
| 4,914,005 | 4/1990 | Lau et al. | 430/627 |
| 4,946,770 | 8/1990 | Takahashi et al. | 430/545 |
| 5,047,316 | 9/1991 | Hirano et al. | 430/545 |
| 5,057,405 | 10/1991 | Shiba et al. | 430/545 |
| 5,091,296 | 2/1992 | Bagchi et al. | 430/545 |
| 5,302,501 | 4/1994 | Tamura et al. | 430/627 |
| 5,445,931 | 8/1995 | Yamanouchi et al. | 430/627 |
| 5,453,352 | 9/1995 | Tachibana | 430/627 |
| 5,576,165 | 11/1996 | Nozawa et al. | 430/545 |
| 5,589,322 | 12/1996 | Lobo et al. | 430/545 |
| 5,731,138 | 3/1998 | Helling et al. | 430/627 |

FOREIGN PATENT DOCUMENTS

| | | |
|---|---|---|
| 0614116A1 | 9/1994 | European Pat. Off. . |
| 2-289840 | 11/1990 | Japan . |

*Primary Examiner*—Richard L. Schilling
*Attorney, Agent, or Firm*—Burns, Doane, Swecker & Mathis, LLP

[57] ABSTRACT

There is disclosed a silver halide color photographic light-sensitive material having at least one silver halide emulsion layer on a base, wherein the said silver halide emulsion layer contains at least one cyan dye-forming coupler and a polymer represented by formula [I]:

$$—(A)_x—(B)_y—$$ formula [I]

wherein A represents a repeating unit derived from at least one ethylenically unsaturated monomer having at least one —COOM group in the molecule, wherein M represents a hydrogen atom or a cation atom; B represents a repeating unit derived from at least one ethylenically unsaturated monomer free from a —COOM group, and x and y are 15 to 85 and 85 to 15, respectively, in terms of weight percentages of A and B, provided that x+y=100. This light-sensitive material can be color-developed in a short period of time, is high in color-forming properties, can produce a cyan dye image improved with regard to blix fading, and can be processed to give a color photograph that keeps the color balance of the image from being destroyed and is improved in image quality.

15 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material (hereinafter also referred to as a light-sensitive material), and more particularly to a silver halide color photographic light-sensitive material excellent in rapid processibility, wherein the density due to the change of the cyan dye in an image to a leuco dye in a bleaching bath or a bleach-fix bath is prevented from decreasing.

BACKGROUND OF THE INVENTION

To form a color photographic image, three color photographic couplers, i.e. a yellow coupler, a magenta coupler, and a cyan coupler, are contained in light-sensitive layers, and after exposure to light they are processed with a color developer containing a color-developing agent. During this process, the oxidation product of an aromatic primary amine, and the couplers, undergo coupling reactions with each other, to give color-formed dyes. Generally, a standard process of processing silver halide color light-sensitive materials comprises a color-developing step of forming a color image, a desilvering step of eliminating developed silver and undeveloped silver, and a washing step and/or an image stabilizing step.

The above desilvering step of eliminating developed silver and undeveloped silver, silver halide, is carried out by reoxidizing developed silver with a bleaching agent and fixing with a silver halide solubilizing agent. The said desilvering can be performed by carrying out successively two separate steps, i.e. a step using a bleaching solution, and a step using a fixing solution, or by carrying out a single step using a single solution of a combination of a bleaching agent with a fixing agent. The solution used in the latter is generally called a bleach-fix (blix) solution. It is known that, as the silver bleaching agent in the above bleaching solution and bleach-fix solution, a variety of oxidizing agents are used, and in view of low toxicity and environmental safety, metal complex salts of organic acids, such as EDTA ferric complex salt, are usually used. The use of complex salts in a bleaching solution and a bleach-fix solution for color photography is described, for example, in U.S. Pat. No. 4,288,618.

However, when such a ferric complex salt is used as a bleaching agent for color photography, sometimes a cyan dye image having a satisfactory density cannot be obtained. This phenomenon is generally recognized as reduction fading (hereinafter referred to as blix fading), and it occurs due to the change of a cyan dye to a leuco dye in a bleaching solution or a bleach-fix solution. U.S. Pat. No. 4,591,548 points out that the cause of the change of a cyan dye to a leuco compound is attributed to the presence of ferrous ions in a bleaching solution or a bleach-fix solution.

On the other hand, although it has hitherto been attempted to shorten the processing time, the need for shortening the processing time has recently been further increased because of demands for a shortened time limit of the delivery of finished products, a decrease in work in laboratories, miniaturization of processing systems for small-scale laboratories, which are so-called mini-labs, simplification of operation of such processing systems, etc.

The shortening of time in a color-developing step can be attained by combining suitably, for example, use of a coupler high in coupling speed, use of a silver halide emulsion high in developing speed, use of a color developer high in development activity, and an increase in temperature of a color developer. T. H. James, "The Theory of the Photographic Process," Section 15, E. Bleach-Fix System (Macmillan Publishing Co., Inc.), describes that, to shorten the time in a desilvering step, it is effective to lower the pH of the bleaching solution or the bleach-fix solution. However, to lower the pH of a bleaching solution or a bleach-fix solution disadvantageously facilitates the above blix fading of a cyan dye.

As an attempt to overcome this reduction fading of a cyan dye, the following various approaches are suggested. For example, JP-A ("JP-A" means unexamined published Japanese patent application) No. 316857/1988 describes that reduction fading is reduced by using a certain hydroquinone or quinone derivative. Further, for example, JP-A Nos. 51136/1989 and 289840/1990 describe that the change of the cyan dye to a leuco dye is suppressed by using an aqueous latex of a polymer having a specified structure. U.S. Pat. Nos. 4,151,680, 4,374,922, and 4,591,546 describe a group of cyan couplers that are preferable for overcoming the foregoing problem.

The effect of some of above-mentioned prior art techniques is not satisfactory, and although others of the above-mentioned prior art techniques are recognized to have an effect, the effect is obtained at the cost of photographic properties, such as image preservability, or they have demerits, such as a harmful influence on the burden of pollution. Therefore a highly effective technique of preventing blix fading of a cyan dye without causing any harmful effects has been desired.

SUMMARY OF THE INVENTION

In view of such circumstances, the present invention has been completed, and an object of the present invention is to provide a silver halide color photographic light-sensitive material that can be color-developed in a short period of time, that is high in color-forming properties, that can produce a dye image improved with regard to blix fading, and that can be processed to give a color photograph that keeps the color balance of the image from being destroyed and is improved in image quality.

Other and further objects, features, and advantages of the invention will appear more fully from the following description.

DETAILED DESCRIPTION OF THE INVENTION

As a result of intensive investigations, the inventors of the present invention have found that the above object can be attained by the following silver halide color photographic light-sensitive material.

(1) A silver halide color photographic light-sensitive material having at least one silver halide emulsion layer on a base, wherein the said silver halide emulsion layer contains at least one cyan dye-forming coupler and a polymer represented by formula [I]:

$$-(A)_x-(B)_y- \qquad \text{formula [I]}$$

wherein A represents a repeating unit derived from at least one ethylenically unsaturated monomer having at least one —COOM group in the molecule, wherein M represents a hydrogen atom or a cation atom; B represents a repeating unit derived from at least one ethylenically unsaturated monomer free from a —COOM group, and x and y are 15 to 85 and 85 to 15, respectively, in terms of weight percentages of A and B, provided that x+y=100. It should be noted that, in this specification, the above formula indicates that the repeating units A and B are present in the above proportions shown by x and y, and there are no particular restrictions on the type of bonding, which means that any type of bonding involved in, for example, a random copolymer, a block copolymer, and a graft copolymer can be accepted.

(2) The silver halide color photographic light-sensitive material as stated in the above (1), wherein the said silver halide emulsion layer contains silver halide grains having a silver chloride content of 90 mol % or more.

(3) The silver halide color photographic light-sensitive material as stated in the above (1) or (2), wherein the said polymer is a polymer represented by the following formula [II]:

formula [II]

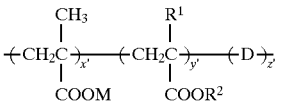

wherein $R^1$ represents a hydrogen atom or a methyl group, $R^2$ represents an alkyl group having 1 to 10 carbon atoms, D represents another ethylenically unsaturated monomer, x', y', and z' are 20 to 80, 80 to 20, and 0 to 30, respectively, in terms of weight percentages of the respective components, provided that x'+y'+z'=100, and M has the same meaning as defined in the above formula [I].

PREFERRED EMBODIMENTS OF THE INVENTION

The present invention will be described in detail below.

The polymer to be used in the present invention will be further described. Examples of the monomer that can give the repeating unit (recurring unit) represented by A include, for example, acrylic acid, methacrylic acid, itaconic acid, crotonic acid, maleic acid, and the followings.

A-1

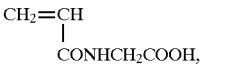

A-2

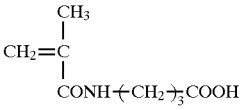

A-3

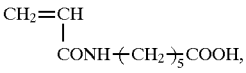

A-4

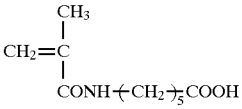

A-5

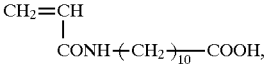

A-6

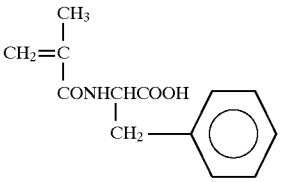

-continued

A-7

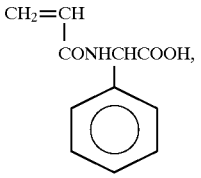

A-8

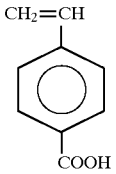

A-9

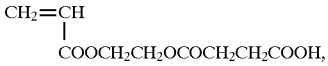

A-10

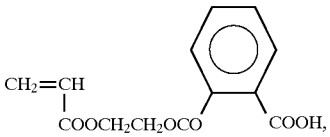

A-11

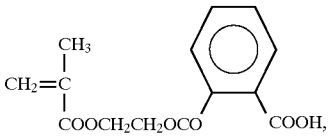

A-12

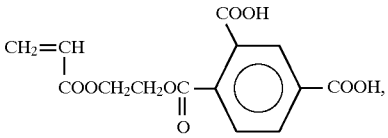

A-13

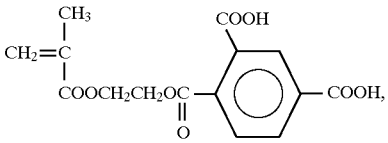

A-14

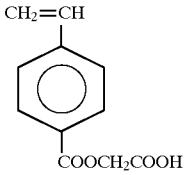

A-15

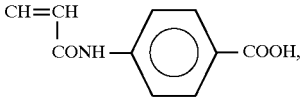

A-16

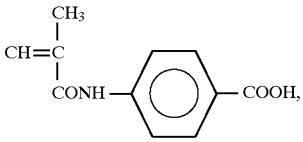

A-17

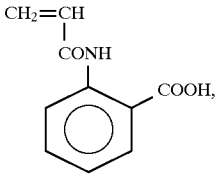

-continued

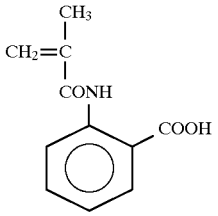

A-18

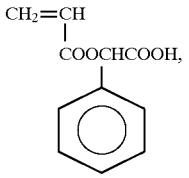

A-19

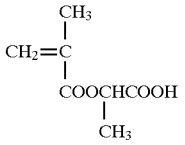

A-20

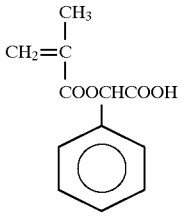

A-21

Further, these monomers may form a salt in the form of —COOM.

Examples of the cation represented by M include, for example, a metal ion (e.g. an alkali metal ion and an alkaline earth metal ion such as a sodium ion and a potassium ion) and an ammonium ion (e.g. an ammonium ion, a dimethyl ammonium ion, and a triethyl ammonium ion).

Examples of the ethylenically unsaturated monomer represented by B are acrylates, specifically methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, n-decyl acrylate, n-dodecyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, and the like;

methacrylates, specifically methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, furfuryl methacrylate, tetrahydrofurfuryl methacrylate, phenyl methacrylate, credyl methacrylate, naphthyl methacrylate, 2-hydroxyethyl methacrylate, 4-hydroxybutyl methacrylate, triethylene glycol monomethacrylate, dipropylene glycol monomethacrylate, and the like;

vinyl esters, specifically vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, and the like;

acrylamides, for example acrylamide, methylacrylamide, ethylacrylamide, propylacrylamide, butylacrylamide, tert-butylacrylamide, cyclohexylacrylamide, benzylacrylamide, hydroxymethylacrylamide, phenylacrylamide, dimethylacrylamide, diethylacrylamide, β-cyanoethylacrylamide, N-(2-acetoacetoxyethyl)acrylamide, diacetaoneacrylamide, and the like;

methacrylamides, for example methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, phenylmethacrylamide, dimethylmethacrylamide, diethylmethacrylamide, β-cyanoethylmethacrylamide, N-(2-acetoacetoxyethyl)methacrylamide, and the like;

olefins, for example dicyclopentadiene, ethylene, propylene, 1-butene, 1-pentene, vinyl chloride, vinylidene chloride, isoprene, chloroprene, butadiene, 2,3-dimethylbutadiene, and the like;

styrenes, for example styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, methyl vinylbenzoate, and the like;

vinyl ethers, for example methyl vinyl ether, butyl vinyl ether, hexyl vinyl ether, methoxyethyl vinyl ether, dimethylaminoethyl vinyl ether, and the like;

as well as crotonates (e.g. butyl crotonate, hexyl crotonate), itaconates (e.g. dimethyl itaconate, dibutyl itaconate), maleates (e.g. diethyl maleate, dimethyl maleate, dibutyl maleate), fumarates (e.g. diethyl fumarate, dimethyl fumarate, dibutyl fumarate), vinyl ketones (e.g. methyl vinyl ketone, phenyl vinyl ketone, methoxyethyl vinyl ketone), glycidyl acrylate, glycidyl methacrylate, N-vinyloxazolidone, N-vinylpyrrolidone, acrylonitrile, methacrylonitrile, methylenemalonitrile, vinylidene chloride, and the like.

Further, B may be copolymerized with a monomer having an anionic group (e.g. a sulfonic acid group or a sulfate group) other than —COOM represented by A, and such an ethylenically unsaturated monomer may be, for example, styrenesulfoninc acid, vinylbenzylsulfonic acid, vinylsulfonic acid, an acryloyloxyalkylsulfonic acid, such as acryloyloxymethylsulfonic acid, acryloyloxyethylsulfonic acid, and acryloyloxypropylsulfonic acid; a methacryloyloxyalkylsulfonic acid, such as methacryloyloxymethylsulfontic acid, methacryloyloxyethylsulfonic acid, and methacryloyloxypropylsulfonic acid; an acrylamidoalkylsulfonic acid, such as 2-acrylamido-2-methylethanesulfonic acid, 2-acrylamido-2-methylpropanesulfonic acid, and 2-acrylamido-2-methylbutanesulfonic acid; a methacryamidoalkylsulfonic acid, such as 2-methacrylamido-2-methylethanesulfonic acid, 2-methacryamido-2-methylpropanesulfonic acid, and 2-methacrylamido-2-methylbutanesulfonic acid, and their salts.

As the ethylenically unsaturated monomer represented by B, a monomer that will form a water-insoluble homopolymer is preferably used. The proportion of the monomer, which will form a water-soluble homopolymer, out of B, is preferably about 0 to 20% based on all the monomers. The ethylenically unsaturated monomer represented by the above B is preferably an acrylate, a methacrylate, and a vinyl ester, and particularly preferably it is an acrylate and a methacrylate.

The monomers represented by the above A and the monomers represented by the above B may be used in a combination of two or more, respectively.

x and y represent weight percentages of the respective components, and preferable ranges thereof vary depending on the structures of the ethylenically unsaturated monomers represented by A and B. x is 15 to 85, preferably 20 to 80, and particularly preferably 25 to 70, and y is 85 to 15, preferably 80 to 20, and particularly preferably 75 to 30, with the proviso that x+y=100.

The polymer for use in the present invention is preferably soluble in water, and out of the water-soluble polymers, particularly preferable ones are represented by the above formula [II].

More particularly, $R^2$ represents a substituted or unsubstituted alkyl group having 1 to 10 carbon atoms. The substituent may be, for example, a phenyl group, a substituted phenyl group, —OH, an alkoxy group, a phenoxy group, a halogen atom, an alkylcarbonyl group, or an alkylcarbonamido group. Specific examples are those described for the above B, and preferably $R^2$ is a hydrocarbon group. Accordingly, particularly preferable examples of $R^2$ are methyl, ethyl, n-propyl, isopropyl, n-butyl, sec-butyl, t-butyl, isobutyl, n-hexyl, n-octyl, 2-ethylhexyl, n-nonyl, n-decyl, benzyl, 2-phenylethyl, and p-methylbenzyl.

D represents a repeating unit of some other ethylenically unsaturated monomer, and specifically D represents a repeating unit of an ethylenically unsaturated monomer selected from the group consisting of monomers, excluding $CH_2{=}C(R^1)COOR^2$ from the above B.

x', y', and z' represent weight percentages of the respective components; and x' is 20 to 80, preferably 25 to 70, y' is 80 to 20, preferably 75 to 30, and z' is 0 to 30, preferably 0 to 15, with the proviso that x'+y'+z'=100.

M has the same meaning as defined for that in the above formula [I].

Among the polymers represented by formula [I] or [II], a methacrylic acid/n-butyl acrylate copolymer is most preferable. In particular, one in which the copolymerization ratio (in weight ratio) of the methacrylic acid monomer to the n-butyl acrylate monomer is in the range of (40:60) to (60:40) is preferable.

Specific examples of the compound represented by formula [I] for use in the present invention are given below, but the present invention is not limited to them.

TABLE 1

| | Copolymerization ratio (weight ratio) | —COOM |
|---|---|---|
| P-1 | Methacrylic acid/n-butyl acrylate copolymer (30/70) | M = H/Na (10/90) |
| P-2 | Methacrylic acid/n-butyl acrylate copolymer (40/60) | M = H/Na (20/80) |
| P-3 | Methacrylic acid/n-butyl acrylate copolymer (50/50) | M = H/Na (20/80) |
| P-4 | Methacrylic acid/n-butyl acrylate copolymer (60/40) | M = H/Na (30/70) |
| P-5 | Methacrylic acid/methyl acrylate copolymer (25/75) | M = H/K (15/85) |
| P-6 | Methacrylic acid/ethyl acrylate copolymer (30/70) | M = H/Na (20/80) |
| P-7 | Methacrylic acid/ethyl acrylate copolymer (60/40) | M = H/Na (20/80) |
| P-8 | Methacrylic acid/n-hexyl acrylate copolymer (45/55) | M = H/Na (20/80) |
| P-9 | Methacrylic acid/cyclohexyl acrylate copolymer (40/60) | M = H/Na (20/80) |
| P-10 | Methacrylic acid/2-ethylhexyl acrylate copolymer (40/60) | M = H/Na (0/100) |
| P-11 | Methacrylic acid/n-decyl acrylate copolymer (40/60) | M = H/Na (0/100) |
| P-12 | Methacrylic acid/methyl methacrylate copolymer (30/70) | M = H/Na (15/85) |
| P-13 | Methacrylic acid/ethyl methacrylate copolymer (40/60) | M = H/Na (20/80) |
| P-14 | Methacrylic acid/n-propyl methacrylate copolymer (40/60) | M = H/Na (20/80) |
| P-15 | Methacrylic acid/sec-butyl methacrylate copolymer (40/60) | M = H/Na (20/80) |
| P-16 | Methacrylic acid/t-butyl methacrylate copolymer (50/50) | M = H/K (10/90) |
| P-17 | Methacrylic acid/2-ethylhexyl methacrylate copolymer (55/45) | M = H/Na (25/75) |
| P-18 | Acrylic acid/ethyl acrylate copolymer (25/75) | M = H/Na (15/85) |
| P-19 | Acrylic acid/n-butyl acrylate copolymer (35/65) | M = H/Na (20/80) |
| P-20 | Acrylic acid/2-ethylhexyl acrylate copolymer (40/60) | M = H/Na (20/80) |
| P-21 | Acrylic acid/methyl methacrylate copolymer (20/80) | M = H/Na (20/80) |
| P-22 | Acrylic acid/ethyl methacrylate copolymer (30/70) | M = H/Na (20/80) |
| P-23 | Acrylic acid/t-butylacrylamide copolymer (30/70) | M = H/Na (20/80) |
| P-24 | Methacrylic acid/n-butyl acrylate/methyl acrylate copolymer (40/40/20) | M = H/Na (20/80) |
| P-25 | Acrylic acid/2-ethylhexyl acrylate/2-hydroxyethyl acrylate copolymer (40/50/10) | M = H/Na (20/80) |
| P-26 | Methacrylic acid/methyl methacrylate/styrene copolymer (40/30/30) | M = H/Na (10/90) |
| P-27 | Methacrylic acid/acrylic acid/benzyl methacrylate copolymer (20/20/60) | M = H/Na (30/70) |
| P-28 | Methacrylic acid/n-butyl acrylate/vinyl acetate copolymer (40/40/20) | M = H/Na (20/80) |
| P-29 | Methacrylic acid/sodium 2-acrylamido-2-methylpropanesufonate/-ethyl methacrylate copolymer (30/5/65) | M = H/Na (20/80) |
| P-30 | Methacrylic acid/itaconic acid/b-butyl acrylate copolymer (30/10/60) | M = H/K (20/80) |
| P-31 | A-1/ethyl acrylate copolymer (60/40) | M = H/Na (15/85) |
| P-32 | A-3/methyl acrylate copolymer (60/40) | M = H/Na (20/80) |
| P-33 | A-3/acrylamide/t-butyl acrylamide copolymer (40/30/30) | M = H/Na (20/80) |
| P-34 | A-8/styrene/methyl methacrylate copolymer (70/15/15) | M = H/Na (0/100) |
| P-35 | A-10/2-hydroxyethyl acrylate/n-butyl acrylate copolymer (60/20/20) | M = H/Na (20/80) |
| P-36 | A-17/n-butyl methacrylate copolymer (80/20) | M = H/Na (10/90) |
| P-37 | A-17/sodium 2-acrylamido-2-methylpropanesulfonate/n-butyl methacrylate copolymer (65/5/30) | M = H/Na (10/90) |
| P-38 | A-1/methacrylic acid/n-butyl acrylate copolymer (20/25/55) | M = H/Na (20/80) |
| P-39 | A-3/methacrylic acid/ethyl acrylate copolymer (30/20/50) | M = H/Na (20/80) |
| P-40 | A-5/acrylic acid/methyl methacrylate copolymer (50/20/30) | M = H/Na (20/80) |

To synthesize the water-soluble copolymer for use in the present invention, it is advantageous to refer to methods described, for example, in British Patent No. 1,211,039, JP-B ("JP-B" means examined Japanese patent publication) No. 29195/1971, British Patent No. 961,395, U.S. Pat. Nos. 3,227,672, 3,290,417, 3,262,919, 3,245,932, 2,681,897, and 3,230,275, John C. Petropoulos et al.'s: Official Digest 33, 719–736 (1961), and "Gosei Kobunshi," 1, 246–290, and 3, 1–108, edited by Shunsuke Murahashi et al.

The polymer for use in the present invention is preferably a water-soluble polymer that can be dissolved in an amount of 1 g or more, more preferably 5 g or more, and further preferably 20 g or more, per 100 g of water at 25° C.

The copolymer for use in the present invention exhibits excellent effects independent of its molecular weight, but taking into consideration diffusion to other layers when the copolymer is applied or processed, and viscosity of its coating solution, its molecular weight is preferably $5\times10^3$ to $1\times10^7$, more preferably $1\times10^4$ to $5\times10^6$, and particularly preferably $2\times10^4$ to $1\times10^6$, in terms of weight-average molecular weight. Further, independent of the neutralization degree (the ratio (%) of components other than free acid component (—COOH) in total of —COOM components) of the water-soluble co-polymer (—COOM component), the water-soluble co-polymer for use in the present invention exhibits excellent effects, but taking into account, for example, the pH when the polymer is mixed with an aqueous gelatin solution, preferably the neutralization degree is 20 to 100%, and particularly preferably 50 to 100%.

As a preferable mode wherein the copolymer for use in the present invention is used, a method can be mentioned wherein the copolymer is dissolved in water and a coating liquid containing the resultant aqueous solution is applied, thereby introducing the copolymer into a photographic light-sensitive material. In this dissolution, preferably a suitable alkali and salt are used. Further, a water-miscible organic solvent (e.g. acetone, methanol, ethanol, isopropyl alcohol, and acetonitrile) may be used as a co-solvent (auxiliary solvent).

In the present invention, the polymer of formula [I] is contained in a cyan coupler-containing layer, and further the polymer may also be added to another photographic constitutional layer, such as a layer (e.g. a UV absorbing layer and an intermediate layer) adjacent to the cyan coupler-containing layer, a magenta coupler-containing layer, and a yellow coupler-containing layer.

As a hydrophilic colloid (binder) that forms the hydrophilic colloid layer containing the copolymer for use in the present invention, gelatin is preferably used, and as the gelatin, lime-processed gelatin, as well as an acid-processed gelatin and an enzyme-processed gelatin, may be used, and also a hydrolyzate and an enzymolyzate of gelatin can be used.

Further a hydrophilic colloid other than gelatin can be used, such as a protein, for example albumin and casein; a cellulose derivative, for example hydroxyethyl cellulose, carboxymethyl cellulose, and cellulose sulfate; a saccharide derivative, for example sodium alginate, dextran, and a starch derivative; and a synthetic hydrophilic polymeric substance that includes a homopolymer and a copolymer, for example a polyvinyl alcohol, a polyvinyl alcohol partial acetal, a poly-N-vinyl pyrrolidone, a polyacrylamide, a polyvinylimidazole, and a polyvinylpyrazole.

After mixing the copolymer for use in the present invention with a hydrophilic colloid, when the mixed coating liquid is applied, preferably the pH of the coating liquid is 5.0 to 8.0, more preferably 5.5 to 7.0, and further preferably 5.8 to 6.5.

There is no particular restriction on the ratio of the copolymer and the hydrophilic colloid used in the present invention (polymer content ratio by weight), and preferably the value of the polymer ratio given by the below-shown formula is 0.02 to 0.30, more preferably 0.03 to 0.20, and further preferably 0.04 to 0.15. If the value of the polymer ratio is too large, there arises a problem that the film quality changes.

Polymer ratio=(the coating amount of the copolymer for use in the present invention)/(the coating amount of the gelatin)

The cyan coupler that can be used in the present invention will be explained.

Examples of the cyan coupler include a phenol, a naphthol, a fused-ring phenol, a pyrazoloazole, an imidazole, a pyrrole, a 3-hydroxypyridine, an active methylene, an active methine, a 5,5-ring-fused heterocyclic, and a 5,6-ring-fused heterocyclic coupler.

As the phenol couplers, use can be made of those, for example, 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A No. 166956/1984; and 2-phenylureido-5-acylaminophenol couplers described, for example, in U.S. Pat. Nos. 3,446,622, 4,333,999, 4,451,559, and 4,427,767.

As the naphthol couplers, use can be made of those, for example, 2-carbamoyl-1-naphthol couplers described, for example, in U.S. Pat. Nos. 2,474,293, 4,052,212, 4,146,396, 4,228,233, and 4,296,200; and 2-carbamoyl-5-amido-1-naphthol couplers described, for example, in U.S. Pat. No. 4,690,889.

As the fused-ring phenol couplers, those described, for example, in U.S. Pat. Nos. 4,327,173, 4,564,586, and 4,904,575, can be used.

As the pyrazoloazole couplers, those described, for example, in U.S. Pat. Nos. 4,873,183 and 4,916,051, JP-A Nos. 199352/1988, 105250/1989, and 105251/1989, can be used.

As the imidazole couplers, those described, for example, in U.S. Pat. Nos. 4,818,672 and 5,051,347, can be used.

As the pyrrole couplers, those described, for example, in JP-A Nos. 188137/1992 and 190347/1992, can be used.

As the 3-hydroxypyridine couplers, those described, for example, in JP-A No. 315736/1989, can be used.

As the active methylene and active methine couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, pyrroloimidazole couplers described in JP-A No. 174429/1992, and pyrrotriazole couplers described, for example, in Europe Patent Nos. 488,248A1, 491,197A1, and 545,300, can be used.

As the 5,6-ring-fused heterocyclic couplers, for example, pyrazolopyrimidine couplers described in U.S. Pat. No. 4,950,585, pyrrolotriazine couplers described in JP-A No. 204730/1992, and couplers described in European Patent No. 556,700, can be used.

Among the above described cyan couplers, cyan couplers having such a structures as a phenol, a naphthol, and a pyrrotriazole are preferable.

Specific examples of cyan couplers that can be used in the present invention are shown below.

(1) 2-Acylamino-5-alkylphenol couplers:
(1-1)
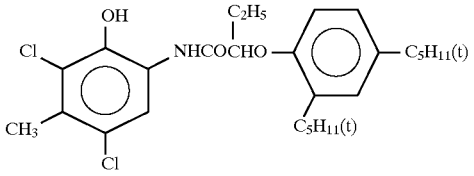
(1-2)
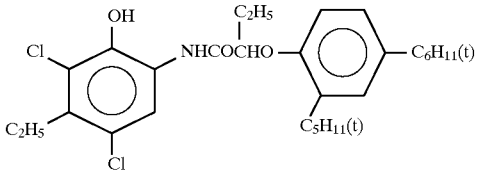
(1-3)
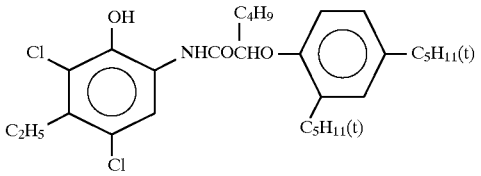
(1-4)
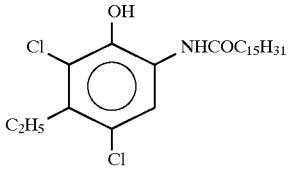
(1-5)
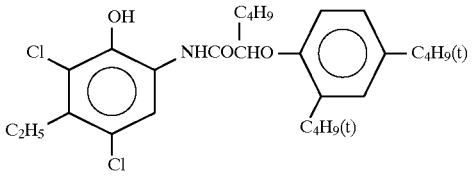
(2) 2,5-Diacylaminophenol couplers:
(2-1)
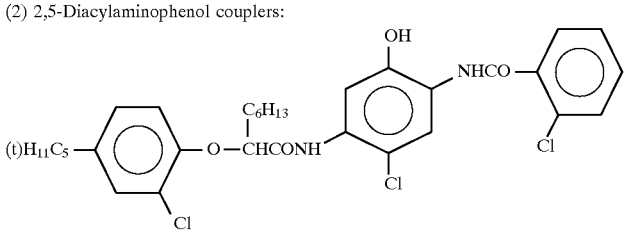
(2-2)
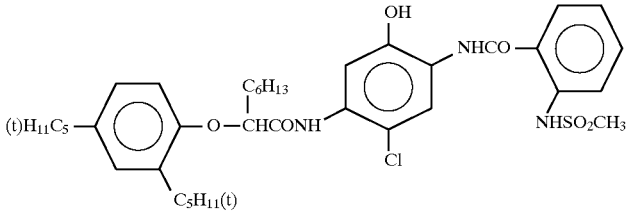
(2-3)
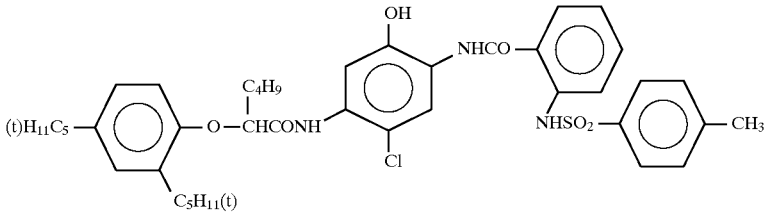

-continued
(2-4)
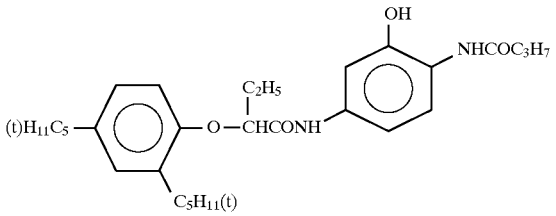
(2-5)
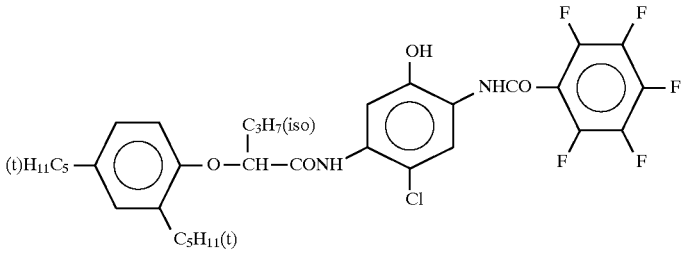
(3) 2-Phenylureido-5-acylamiophenol couplers:
(3-1)
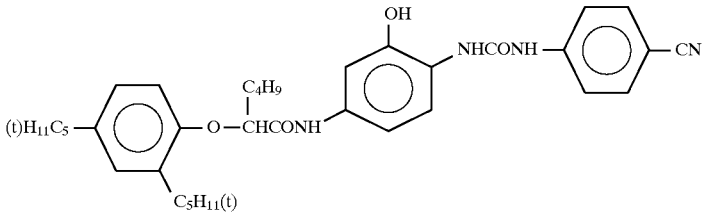
(3-2)
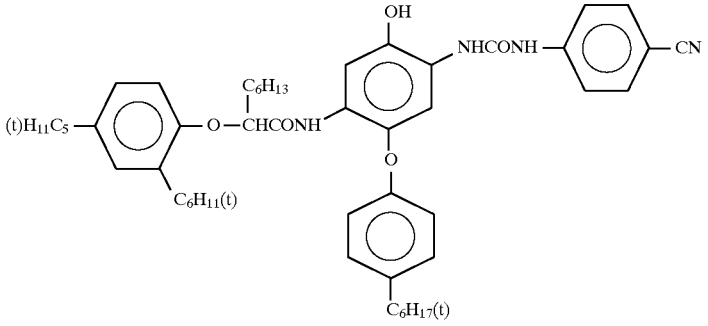
(4) 2-Carbamoyl-1-naphthol couplers:
(4-1)
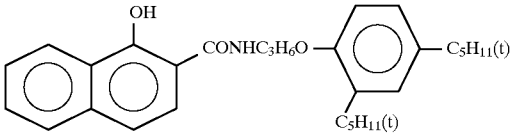
(4-2)
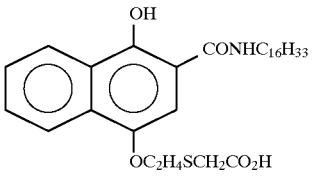
(5) 2-Carbamoyl-5-amido-1-naphthol couplers:
(5-1)
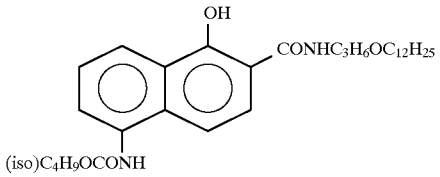

-continued
(5-2)
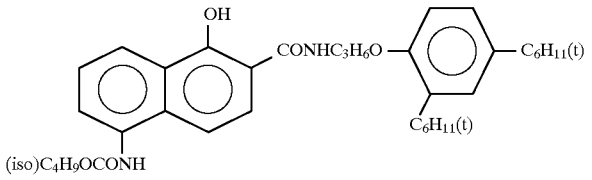
(5-3)
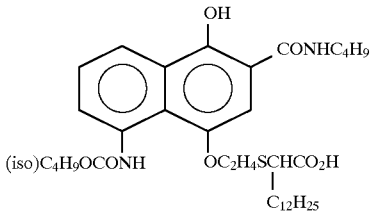
(6) Fused-ring phenol coulpers:
(6-1)
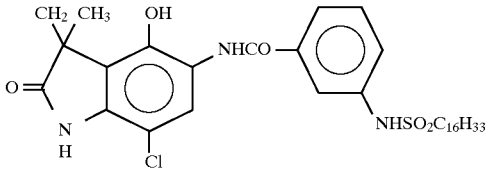
(6-2)
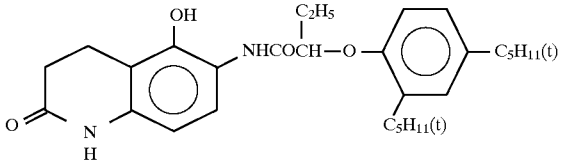
(7) Pyrazoloazole couplers:
(7-1)
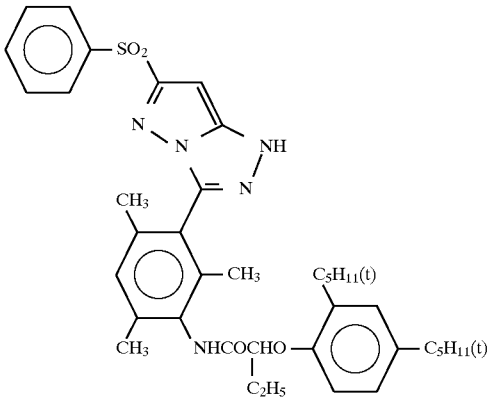
(7-2)
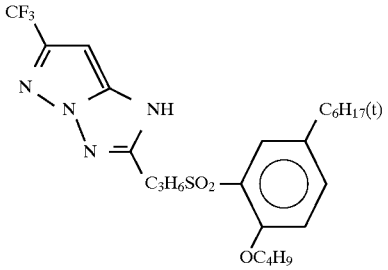
(8) Imidazole couplers:

-continued
(8-1)
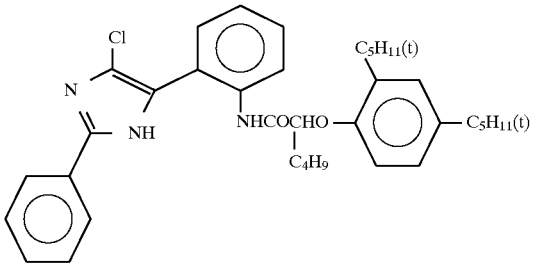
(8-2)
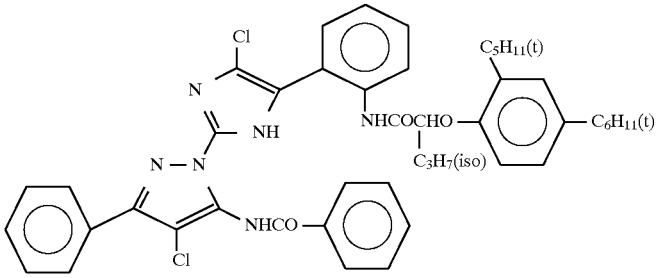
(9) Pyrrole couplers:
(9-2)
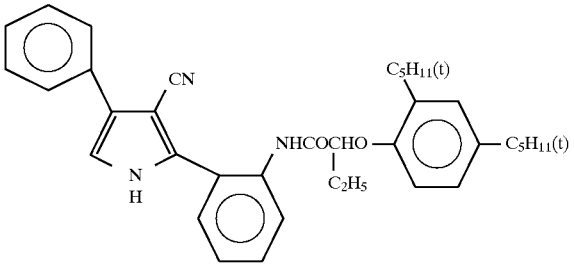
(10) 3-Hydroxypyridine couplers:
(10-1)
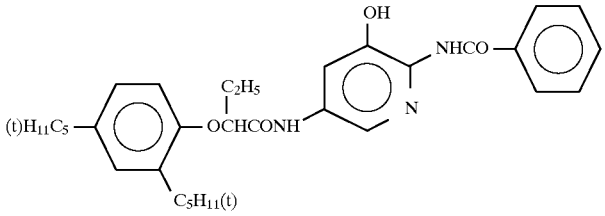
(11) Active methylene and active methine couplers:
(11-1)
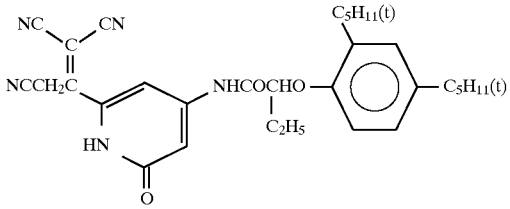
(11-2)
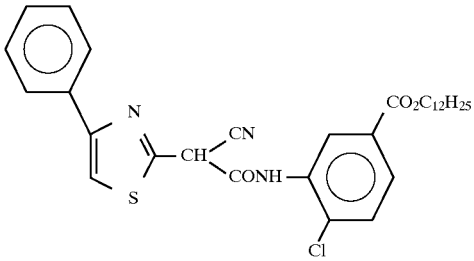
(12) 5,5-Ring-fused heterocyclic couplers:

-continued
(12-1)
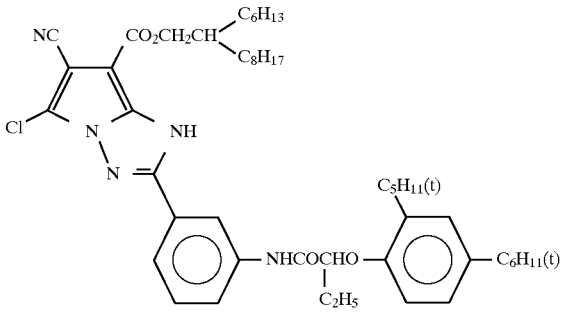
(12-2)
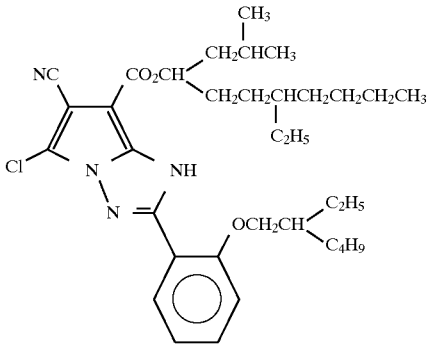
(12-3)
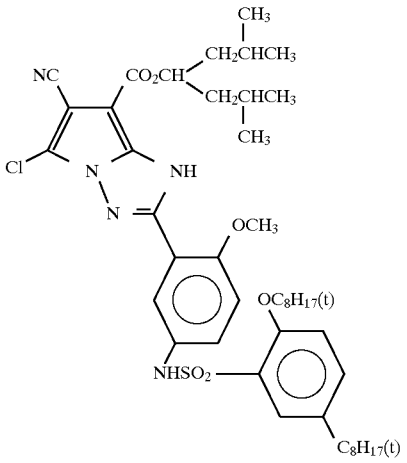
(12-4)
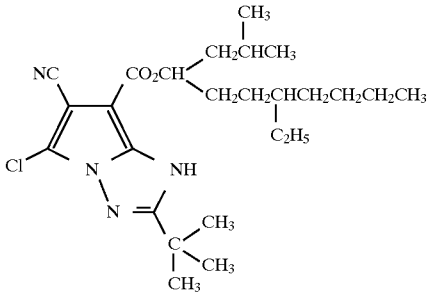

-continued
(12-5)
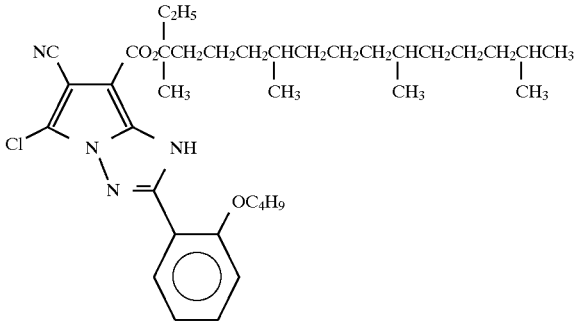
(12-6)
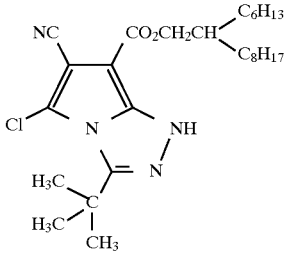
(12-7)
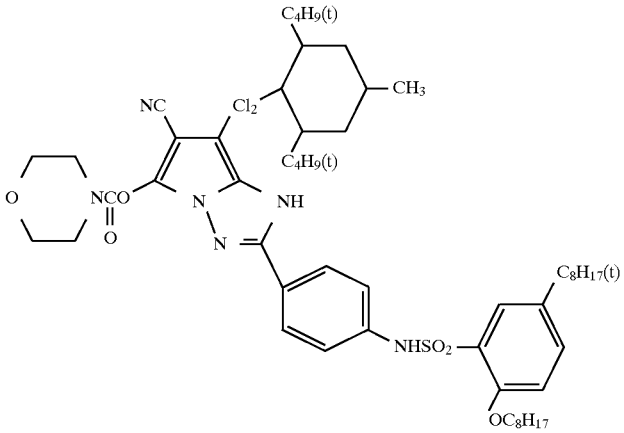
(12-8)
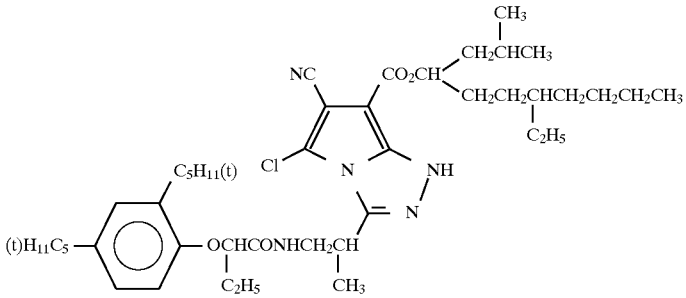
(12-9)
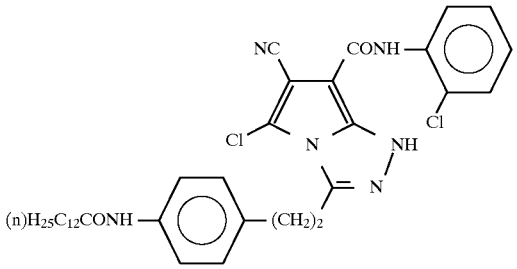

-continued
(12-10)
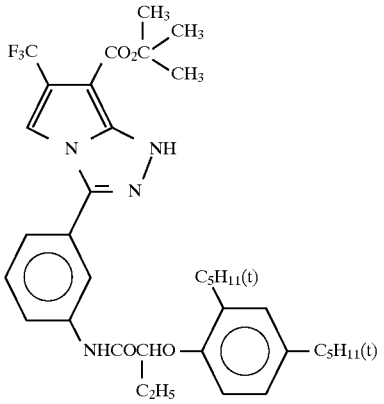
(12-11)
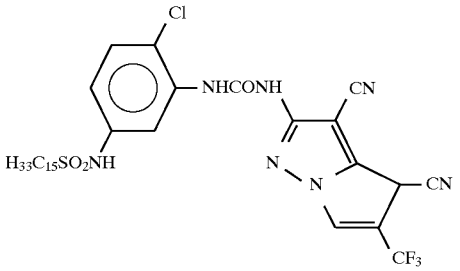
(12-12)
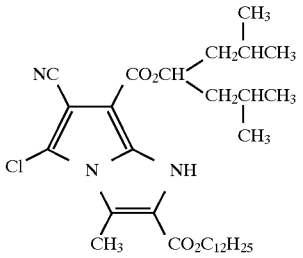
(13) 5,6-Ring-fused heterocyclic couplers:
(13-1)
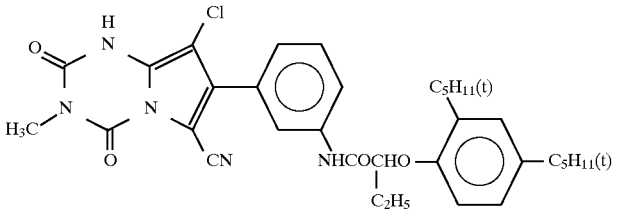
(13-2)
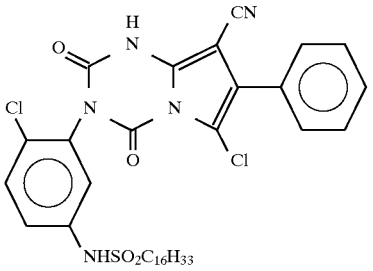

-continued (13-3)

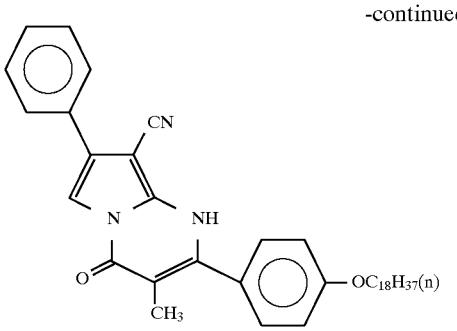

In the present invention, in addition to the couplers described in the above-mentioned patent specifications, use can be made of couplers described, for example, in West Germany Patent Nos. 3,819,051A1 and 3,823,049, U.S. Patent No. 4,840,883, European Patent Nos. 304,856A2, 329,036, 354,549A2, 374,781A2, 379,110A2, 386,930A1, and 386,931A1, U.S. Pat. Nos. 5,024,930 and 5,051,347, and JP-A Nos. 141055/1988, 32260/1989, 32261/1989, 297547/1990, 44340/1990, 110555/1990, 7938/1991, 160440/1991, 172839/1991, 172447/1992, 179949/1992, 182645/1992, 184437/1992, 188138/1992, 188139/1992, 194847/1992, 204532/1992, 204731/1992, and 204732/1992.

In the present invention, there is no particular restriction on the amount of the cyan coupler to be added, and the amount of the cyan coupler to be added is generally 10−3 to 1 mol, preferably 0.1 to 0.8 mol, and more preferably 0.25 to 0.5 mol, per mol of silver halide. With respect to the amounts of the yellow coupler and the magenta coupler to be added, amounts that are generally used can be used.

The color light-sensitive material of the present invention is made up by layering, on a base, at least one yellow color-forming silver halide emulsion layer, at least one magenta color-forming silver halide emulsion layer, and at least one cyan color-forming silver halide emulsion layer. In the general color photographic printing paper, color couplers capable of forming dyes complementary to the lights to which the silver halide emulsions are sensitive, respectively, are contained, so that color reproduction by the subtractive color process can be effected. In the general color photographic printing paper, the silver halide emulsion grains are spectrally sensitized with blue-sensitive, green-sensitive, and red-sensitive spectral-sensitizing dyes, in the above-mentioned order of the color-forming layers, respectively, and are applied on a base in the above-mentioned order. However the order may be changed. That is, in some cases, in view of rapid processing, preferably a light-sensitive layer containing silver halide grains whose average grain size is the greatest is placed as an uppermost layer, or in some cases, in view of the preservability under irradiation with light, preferably the lowermost layer is a magenta color-forming light-sensitive layer.

Further, light-sensitive layers and color-forming hues may not have the above correspondence, and at least one infrared-sensitive silver halide emulsion layer can also be used.

As the support (base) to be used in the present invention, any support can be used if it is a support on which a photographic emulsion layer can be coated, such as glass, paper, and plastic film, and reflective support is most preferable.

"The reflective support" that can be used in the present invention refers to a support that increases the reflecting properties to make bright the dye image formed in the silver halide emulsion layer, and such a reflective support includes a support coated with a hydrophobic resin containing a light-reflecting substance, such as titanium oxide, zinc oxide, calcium carbonate, and calcium sulfate, dispersed therein, or a support made of a hydrophobic resin itself containing a dispersed light-reflecting substance. Examples are a polyethylene-coated paper, a polyethylene trephthalate-coated paper, a polypropylene-series synthetic paper, a transparent support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. The reflective support to be used in the present invention is preferably a paper support, both surfaces of which are coated with a water-resistant resin layer, and at least one of the water-resistant resin layers contains fine particles of a white pigment.

By water-resistant resin of the reflective-type base to be used in the present invention is meant a resin having a water absorption (in % by weight) of 0.5 or less, and preferably 0.1 or less, and examples thereof include a polyolefin, such as a polyethylene, a polypropylene, and a polyethylene-series polymer; a vinyl polymer or a vinyl copolymer (e.g. a polystyrene, a polyacrylate, and their copolymers); a polyester (e.g. a polyethylene terephthalate and a polyethylene isophthalate), and its copolymer, with particular preference given to a polyethylene and a polyester.

As the polyethylene, a high-density polyethylene, a low-density polyethylene, a linear low-density polyethylene, and a blend of these polyethylenes can be used. The melt flow rate (hereinafter abbreviated to MFR) of these polyethylene resins before processing is preferably in the range of 1.2 g/10 min to 12 g/10 min, in terms of the value measured under conditions 4 in Table 1 in JIS K 7210. Herein, the term "MFR of the polyolefin resin before processing" indicates the MFR of the resin into which a bluing agent and a white pigment have not yet been kneaded.

As the polyester, a polyester synthesized by condensation polymerization of a dicarboxylic acid with a diol is preferred. As a preferable dicarboxylic acid, for example, terephthalic acid, isophthalic acid, and naphthalenedicarboxylic acid can be mentioned. As a preferable diol, for example, ethylene glycol, butylene glycol, neopentyl glycol, triethylene glycol, butanediol, hexylene glycol, bisphenol A/ethylene oxide adduct (2,2-bis(4-(2-hydroxyethyloxy) phenyl)propane), and 1,4-dihydroxymethylcyclohexane can be mentioned.

Various polyesters obtained by condensation polymerization of one of, or a mixture of, these dicarboxylic acids with one of, or a mixture of, these diols can be used. In particular, at least one of dicarboxylic acids is preferably terephthalic acid. Further, as the dicarboxylic acid component, a mixture of terephthalic acid and isophthalic acid (in a mole ratio of from 9:1 to 2:8), or a mixture of terephthalic acid and naphthalenedicarboxylic acid (in a mole ratio of from 9:1 to 2:8), is also preferably used. Further, as the diol, ethylene glycol, or a mixed diol containing ethylene glycol, is preferably used. Preferably the molecular weight of these polymers is 30,000 to 50,000.

Also, preferably a mixture of these polyesters different in composition is used. A mixture of these polyesters with another resin is also preferably used. As the other resins to be mixed, a wide variety of resins can be chosen, as long as the resins can be extruded at 270° to 350° C., and examples include polyolefins, such as a polyethylene and a polypropylene; polyethers, such as a polyethylene glycol, a polyoxymethylene, and a polyoxypropylene; a polyester-series polyurethane, a polyether polyurethane, a polycarbonate, and a polystyrene. These resins to be blended may be used singly or in a combination of two or more. For example, 90% by weight of a polyethylene terephthalate, 6% by weight of a polyethylene, and 4% by weight of a polypropylene can be mixed. The mixing ratio of the polyester to another resin varies depending on the type of the resin to be mixed, and the ratio is suitably such that, in the case of polyolefins, the polyester/other resin is from 100/0 to 80/20 in terms of weight ratio. If the mixing ratio is outside the stated range, the physical properties of the mixed resin drop radically. In the case of resins other than polyolefins, the polyester and other resins can be mixed in the range of from 100/0 to 50/50 in terms of weight ratio.

The mixing ratio of the above water-resistant resin to a white pigment is from 98/2 to 30/70, preferably from 95/5 to 50/50, and particularly preferably from 90/10 to 60/40, in terms of weight ratio (water-resistant resin/white pigment). If the amount of white pigment is too small, it contributes to the whiteness unsatisfactorily, while if the amount is too large, the surface smoothness of the obtainable photographic base is unsatisfactory and a photographic base excellent in glossiness cannot be secured.

Preferably these water-resistant resin layers are coated on a base to have a thickness of 2 to 200 μm, and more preferably 5 to 80 μm. If the thickness is too thick, the brittleness of the resin is enhanced, and there arise problems of physical properties that will cause breakage or the like. If the thickness is too thin, the waterproofness, which is the fundamental purpose of the coating, is impaired, and in addition the whiteness and the surface smoothness cannot be satisfied simultaneously, and further the layer unfavorably becomes physically too soft.

The thickness of the resin or resin composition that will be applied to the surface of the base where the light-sensitive layers are not applied is preferably 5 to 100 μm, and more preferably 10 to 50 μm. If the thickness exceeds that range, the brittleness of the resin is enhanced, and there arise problems of physical properties that will cause breakage or the like. On the other hand, if the thickness is below the range, the waterproofness, which is the fundamental purpose of the coating, is impaired, and further the layer unfavorably becomes physically too soft.

In the reflective base used in the present invention, preferably in some cases the reflective base is a reflective base in which a water-resistant resin coat layer on the side where the light-sensitive layer is applied comprises two or more water-resistant resin coat layers different in content of a white pigment, in view, for example, of the cost and the suitability for production of the base. In that case, out of the water-resistant resin coat layers different in white pigment content, the water-resistant resin coat layer situated nearest to the base has preferably a white pigment content lower than that of at least one water-resistant resin coat layer located above the former water-resistant resin coat layer. As a more preferable mode can be mentioned a reflective base in which, out of the water-resistant resin coat layers different in white pigment content, the water-resistant resin coat layer nearest to the light-sensitive layer has the highest white pigment content, or a reflective base in which the reflective base comprises at least three water-resistant resin coat layers, and, of the multilayer water-resistant resin layer, any one of intermediate layers other than the water-resistant resin coat layer located nearest to the light-sensitive layer, and other than the water-resistant resin coat layer located nearest to the base, has the highest white pigment content.

The white pigment content of each layer of the multilayer water-resistant resin layer is generally 0 to 70% by weight, preferably 0 to 50% by weight, and more preferably 0 to 40% by weight. The white pigment content of the layer having the highest white pigment content in the multilayer water-resistant resin layers is generally 9 to 70% by weight, preferably 15 to 50% by weight, and more preferably 20 to 40% by weight. If the white pigment content of this layer is too small, the sharpness of the image is low, while if the white pigment content of this layer is too large, the melted and extruded film will be broken with causing a breakage of film.

Further, the thickness of each layer of the multilayer water-resistant resin layer is preferably 0.5 to 50 μm. For example, in the case of a multilayer water-resistant resin layer comprising two layers, the thickness of each layer is preferably 0.5 to 50 μm, and the total thickness obtained by combining them is preferably within the above range (2 to 200 μm). In the case of a multilayer water-resistant layer comprising three layers, preferably the thickness of the uppermost layer is 0.5 to 10 μm, the thickness of the intermediate layer is 5 to 50 μm, and the thickness of the lowermost layer (the layer nearest to the base) is 0.5 to 10 μm. If the thickness of the uppermost layer and the lowermost layer is too thin, the white pigment highly loaded into the intermediate layer is apt to cause die lip streaks. On the other hand, if the thickness of the uppermost layer and the lowermost layer, particularly the uppermost layer, is too thick, the sharpness is apt to be lowered.

Preferably the white pigment fine particles are homogeneously dispersed in the reflective layer without forming aggregates of particles, and the magnitude of the distribution can be found by measuring the occupied area proportions (%) (Ri) of fine particles projected on a unit area. The deviation coefficient of the occupied area proportions (%) can be found by the ratio s/R of the standard deviation s of Ri to the average value (R) of Ri. In the present invention, preferably the deviation coefficient of the occupied area proportions (%) of the fine particles of the pigment is 0.15 or less, more preferably 0.12 or less, and particularly preferably 0.08 or less.

In the present invention, a support having a diffuse reflective surface of a second kind can be preferably used. "Diffuse reflectivity of a second kind" means diffuse reflectivity obtained by making a specular surface uneven, to form finely divided specular surfaces facing different directions, which finely divided surfaces, specular surfaces, are dispersed in their directions. The unevenness of the diffuse reflective surface of the second kind preferably has a three-dimensional average coarseness of 0.1 to 2 μm, and more preferably 0.1 to 1.2 μm, for the center surface. The frequency of unevenness of the surface is preferably in the range of 0.1 to 2000 cycle/mm, and more preferably 50 to 600 cycle/mm, per unevenness having coarseness of 0.μm or more. Details about such a support are described in JP-A No. 239244/1990.

In the present invention, as silver halide grains, preferably grains of silver chloroiodobromide, silver chlorobromide, or silver chloride, respectively made up of 95 mol % or more of silver chloride, are used. Particularly, in the present invention, grains made up of silver chloride or silver chlorobromide substantially free from silver iodide can be preferably used in order to shorten the development processing time. Herein the expression "substantially free from silver iodide" means that the silver iodide content is 1 mol % or less, and preferably 0.2 mol % or less. On the other hand, in some cases, for the purpose of increasing high illumination sensitivity, spectral sensitization sensitivity, or stability of the light-sensitive material with the passing of time, high-silver-chloride grains containing 0.01 to 3 mol % of silver iodide on the emulsion surface, as described in JP-A No. 84545/1991, are preferably used. The halogen composition of the emulsion may be different or the same from grain to grain. When an emulsion whose halogen composition is the same from grain to grain is used, the properties may be easily made homogeneous from grain to grain. With respect to the halogen composition distribution within silver halide emulsion grains, for example, grains having the so-called uniform-type structure, wherein the composition of every part of the silver halide grains is the same; grains having the so-called layered structure, wherein the halogen composition of the cores inside the silver halide grains is different from that of the shells (each comprising a single layer or layers) surrounding the cores; or grains having a structure having parts different in halogen composition within the grains or on the surfaces of the grains in a non-layered manner (a structure wherein the parts different in halogen composition are conjugated on the edges, corners, or planes of the surface of the grain, when such parts exist on the grain surface.), can be suitably chosen for use. In order to secure a high sensitivity, the grains of any of the latter two types of grains, rather than the grains having a uniform-type structure, are advantageous for use and also preferable in view of pressure resistance. When the silver halide grains have the structures as indicated above, the boundary of parts different in halogen composition may be distinctive or obscure by forming mixed crystals due to different compositions, or the said boundary may be positively continuously changed in structure.

The high-silver-chloride emulsion used in the present invention has preferably a structure in which a silver bromide localized phase is present within the silver halide grains and/or on the surface of the silver halide grains in a layered manner or non-layered manner, as described above. Preferably the halogen composition of the above localized phase has a silver bromide content of at least 10 mol %, and more preferably over 20 mol %. The silver bromide content of the silver bromide localized phase can be analyzed by X-ray diffractometry (e.g. described in *Shinjikken Kagaku-koza* 6, *Kozo Kaiseki*, edited by Nihon Kagaku-kai and published by Maruzen) or the like. The localized phase can be present within the grains or on the edges, corners, or planes of the surfaces of the grains. As one preferable example of the localized phase, a localized phase epitaxially grown on the corners of the grains can be mentioned.

Further, for the purpose of reducing the replenishment rate of a development processing liquid, it is also effective to increase further the silver chloride content of the silver halide emulsion. In that case, an emulsion of a nearly pure silver chloride, for example, having a silver chloride content of 98 to 100 mol %, is also preferably used.

The average grain size of the silver halide grains contained in the silver halide emulsion used in the present invention (the diameters of circles equivalent to the projected areas of the grains are assumed as the grain sizes, and the number average of them is defined as the average grain size) is preferably 0.1 to 2 μm.

The grain size distribution is preferably a so-called monodisperse distribution having a deviation coefficient (obtained by dividing the standard deviation of the grain size distribution by the average grain size) of generally 20% or less, desirably 15% or less, and more preferably 10% or less. In this case, for the purpose of obtaining a wide latitude, it is also preferable to conduct blending of such monodisperse emulsions in a single layer for use, or to apply such monodisperse emulsions on top of one another (interlayer coating).

As the shape of the silver halide grains contained in the photographic emulsion, a regular crystal shape, such as a cubic shape, a tetradecahedral shape, and an octahedral shape; an irregular crystal shape, such as a spherical shape and a tabular shape; or a complex shape of these can be used. Also a mixture of various crystal shapes may be used. In the present invention, in particular, recommendably grains having the above regular crystal shape are contained in an amount of 50% or more, preferably 70% or more, and more preferably 90% or more. Further, in addition to them, an emulsion wherein tabular grains having an average aspect ratio (circle equivalent diameter/thickness) of 5 or more, and preferably 8 or more, are present in an amount of more than 50% in all grains in terms of projected areas, can also be preferably used.

The silver (bromo)chloride emulsion used in the present invention can be prepared by a method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964. That is, any of the acid process, the neutral process, the ammonia process, and the like can be used; and to react a soluble silver salt with a soluble halogen salt, any of the single-jet method, the double-jet method, a combination thereof, and the like can be used. A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used. According to this method, a silver halide emulsion wherein the crystals are regular in shape and whose grain size is approximately uniform, can be obtained.

The localized phase or the substrate of the silver halide grains for use in the present invention preferably contains different metal ions or their complex ions. Preferable metals are chosen from among ions or complexes of metals of Groups VIII and IIb of the Periodic Table, lead ions, and thallium ions. In the localized phase, mainly, ions or complex ions chosen from among ions or complex ions of iridium, rhodium, iron, and the like can be used alone or in combination, and in the substrate, mainly, ions or complex ions chosen from among ions or complex ions of osmium, iridium, rhodium, platinum, ruthenium, palladium, cobalt, nickel, iron, and the like can be used alone or in combination. Further, in the localized phase and the substrate, the types of metal ions and the concentrations of metal ions may be different. These metals may be used in a combination of two or more. Particularly preferably an iron compound and an iridium compound are present in the silver bromide localized phase.

The compounds providing these metal ions are put into the localized phase and/or other grain part (substrate) of the silver halide grains for use in the present invention, for example, by means of dissolving them in an aqueous gelatin solution, an aqueous halide solution, an aqueous silver salt solution, or some other aqueous solution that will serve as a dispersion medium when the silver halide grains are formed, or they are so put by means of adding and dissolving silver halide fine particles in which metal ions are allowed to be contained previously.

The metal ions to be used in the present invention can be contained in emulsion grains before, during, or immediately after the formation of the grains. This timing will depend on where the metal ions are located in the grains.

Generally the silver halide emulsion to be used in the present invention is chemically and spectrally sensitized.

As the chemical sensitization, the type using a chalcogen sensitizer (specifically, sulfur sensitization, represented by addition of an unstable sulfur compound; selenium sensitization, using a selenium compound; and tellurium sensitization, using a tellurium compound, can be mentioned), noble metal sensitization, represented by gold sensitization, reduction sensitization, and the like can be used singly or in combination. As compounds used in the chemical sensitization, those described in JP-A No. 215272/1987, page 18, right lower column, to page 22, right upper column, can be preferably used.

The effect of the constitution of the light-sensitive material of the present invention is more remarkable when a high-silver-chloride emulsion sensitized with gold is used. The emulsion to be used in the present invention is a so-called surface-latent-image-type emulsion, wherein a latent image will be formed mainly on the grain surfaces.

To the silver halide emulsion to be used in the present invention, may be added various compounds or their precursors for the purpose of preventing fogging in the step of producing the light-sensitive material, during the storage of the light-sensitive material, or during the photographic processing of the light-sensitive material, or for the purpose of stabilizing the photographic properties. Specific examples of these compounds that are preferably used are those described in the above-mentioned JP-A No. 215272/1987, pages 39 to 72. 5-Arylamino-1,2,3,4-thiatriazole compounds, wherein the aryl residue has at least one electron-attracting group, described in European Patent No. 0,447,647, are also preferably used.

The spectral sensitization is carried out for the purpose of spectrally sensitizing, in a desired wavelength range, the emulsion of each layer in the light-sensitive material of the present invention.

As the spectral sensitizing dye to be used for spectral sensitization in the blue, green, and red ranges in the light-sensitive material of the present invention, for example, those described by F. M. Harmer in *Heterocyclic compounds-Cyanine dyes and related compounds* (John Wiley & Sons, New York, London, 1964) can be mentioned. Specific exemplary compounds and spectral sensitizations are those described in the above-mentioned JP-A No. 215272/1987, page 22, right upper column, to page 38, which are preferably used. As red-sensitive spectral sensitizing dyes for silver halide emulsion grains particularly high in silver chloride content, those described in JP-A No. 123340/1991 are very preferred in view, for example, of the stability and the intensity of absorption and the temperature dependency of exposure.

When the light-sensitive material of the present invention is to be spectrally sensitized effectively in the infrared range, sensitizing dyes described in JP-A No. 15049/1991, page 12, left upper column, to page 21, left lower column; JP-A No. 20730/1991, page 4, left lower column, to page 15, left lower column; European Patent No. 0,420,011, page 4, line 21, to page 6, line 54; European Patent No. 0,420,012, page 4, line 12, to page 10, line 33; European Patent No. 0,443,466, and U.S. Pat. No. 4,975,362 are preferably used.

To put these spectral sensitizing dyes into the silver halide emulsion, they may be directly dispersed in the emulsion or may be dissolved in a solvent or a mixed solvent, for example, of water, methanol, ethanol, propanol, methyl cellosolve, and/or 2,2,3,3-tetrafluoropropanol, to be added to the emulsion. Alternatively, the spectral sensitizing dye may be made into an aqueous solution by allowing an acid or a base to coexist, as described, for example, in JP-B Nos. 23389/1969, 27555/1969, and 22089/1982, or the said dye may be made into an aqueous solution or a colloid dispersion by allowing a surface-active agent to coexist, as described in U.S. Pat. Nos. 3,822,135 and 4,006,025, and the thus prepared aqueous solution or colloid dispersion may be added to the emulsion. Also, the spectral sensitizing dye may be dissolved in a solvent substantially incompatible with water, such as phenoxyethanol, and the resultant solution may be dispersed in water or a hydrophilic colloid and added to the emulsion. The spectral sensitizing dye may be directly dispersed in a hydrophilic colloid, as described in JP-A Nos. 102733/1978 and 105141/1983, and the resultant dispersion may be added to the emulsion. The addition to the emulsion may be carried out at any stage for the preparation of the emulsion that is hitherto known to be effective. Specifically, the addition can be carried out before the formation of the grains of the silver halide emulsion, during the formation of the grains, during the period from immediately after the formation of the grains to before the washing step, before or during the chemical sensitization, during the period from immediately after the chemical sensitization to the cooling and solidification of the emulsion, or during the preparation of the coating liquid. Most usually, the addition is carried out during the period from after the completion of the chemical sensitization to before the coating. Alternatively the addition can also be carried out simultaneously with the addition of a chemical sensitizer to effect the spectral sensitization and the chemical sensitization simultaneously, as described in U.S. Pat. Nos. 3,628,969 and 4,225,666, or the addition can also be carried out prior to the chemical sensitization as described in JP-A No. 113928/1983, or it can also be carried out before the completion of the formation of the precipitate of the silver halide grains to start the spectral sensitization. Further, as taught in U.S. Pat. No. 4,225,666, the spectral sensitizing dye can also be added in portions; that is, part of the spectral sensitizing dye is added prior to the chemical sensitization, and the remainder is added after the chemical sensitization, and the addition may be carried out at any time during the formation of the silver halide grains using, for example, a method taught in U.S. Pat. No. 4,183,756. In particular, the sensitizing dye is preferably added before the step of washing the emulsion or before the chemical sensitization.

The amount of these spectral sensitizing dyes to be added varies widely depending on the particular case, but it is preferably in the range of $0.5\times10^{-6}$ mol to $1.0\times10^{-2}$ mol, and more preferably $1.0\times10^{-6}$ mol to $5.0\times10^{-3}$ mol, per mol of the silver halide.

In the present invention, when a sensitizing dye having a spectral sensitizing sensitivity particularly in the range from the red region to the infrared region is used, preferably compounds described in JP-A No. 157749/1990, page 13, right lower column, to page 22, right lower column, are additionally used. By using these compounds, the preservability of the light-sensitive material, the stability of the processing, and the supersensitization effect can be specifically increased. Particularly preferably, compounds of formulae (IV), (V), and (VI) described in that patent are additionally used. These compounds can be used in an amount of generally $0.5\times10^{-5}$ mol to $5.0\times10^{-2}$ mol, and preferably $5.0\times10^{-5}$ mol to $5.0\times10^{-3}$ mol, per mol of the silver halide, and an advantageous amount is in the range of generally 0.1 to 10,000 times, and preferably 0.5 to 5,000 times, the mole of the sensitizing dye.

The light-sensitive material of the present invention is used in a print system using usual negative printers, and also it is preferably used for digital scanning exposure that uses monochromatic high-density light, such as a second high harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the light-sensitive material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. When the above value of the optical density is within the preferable range, the sharpness of the image is further improved. The shorter the scanning exposure time is, the shorter the exposure time can be made, which is suitable for rapid processing.

For the purpose of preventing irradiation or halation and improving safelight immunity and the like, into the hydrophilic colloid layer of the light-sensitive material according to the present invention, may be preferably added dyes (particularly oxonol dyes and cyanine dyes) capable of being decolored by processing, as described in European Patent No. 0,337,490 A2, pages 27 to 76.

When some of these water-soluble dyes are used in an increased amount, color separation and safelight immunity are deteriorated. As dyes that can be used without deteriorating color separation, water-soluble dyes described in European Patent No. 0,539,978 Al and JP-A Nos. 127325/1993 and 127324/1993 are preferable.

In the present invention, instead of the water-soluble dye or in combination with the water-soluble dye, a colored layer that can be decolored by processing may be used. The colored layer to be used that can be decolored by processing may be directly adjacent to the emulsion layer, or it may be arranged to be adjacent to the emulsion layer through an intermediate layer containing a processing color-mixing inhibitor, such as gelatin and hydroquinone. Preferably the colored layer is arranged below (on the side of the support) an emulsion layer that will form the same primary color as the color of the colored layer. All or some of colored layers corresponding to respective or arbitrarily selected primary colors may be arranged. Also, colored layer corresponding to plural primary color regions may be arranged. The optical reflection density of the colored layer is preferably such that the optical density value at the wavelength having the highest optical density in the wavelength region used for exposure (the visible light region of from 400 nm to 700 nm, in the case of usual printer exposure, and the wavelength of the scanning exposure light source to be used, in the case of scanning exposure) is 0.2 or more but 3.0 or less, more preferably 0.5 or more but 2.5 or less, and particularly preferably 0.8 or more but 2.0 or less.

To form the colored layer, conventionally known methods can be applied. For example, use can be made of a method wherein dyes described in JP-A No. 282244/1990 (page 3, upper right column, to page 8), or dyes described in JP-A No. 7931/1991 (page 3, upper right column, to page 11, lower left column), are made into a solid fine particle dispersion state and are contained in a hydrophilic colloid layer; a method wherein a cationic polymer is mordanted with an anionic dye; a method wherein a dye is adsorbed to fine particles, for example, of a silver halide, and is fixed in a layer; and a method, as described in JP-A No. 239544/1989, wherein colloidal silver is used. One method wherein a fine powder of a dye is dispersed in the solid state is described in JP-A No. 308244/1990 (pages 4 to 13); in the method, for example, a fine powder dye, which is substantially insoluble in water, at least at a pH of 6 or below, but which is substantially soluble in water, at least at a pH of 8 or over, is contained. Further, a method wherein a cation polymer is mordanted with an anionic dye is described in JP-A No. 84637/1990 (pages 18 to 26). Methods of the preparation of colloidal silver as a light absorber are described in U.S. Pat. Nos. 2,688,601 and 3,459,563. Among these methods, one in which a fine powder dye is contained, and one in which colloidal silver is used, are preferable.

As a binder or a protective colloid that can be used in the light-sensitive material according to the present invention, a gelatin is advantageously used, and other hydrophilic colloids can be used alone or in combination with a gelatin. As the gelatin, a low-calcium gelatin having a calcium content of 800 ppm or less, and more preferably 200 ppm or less, is preferably used. Further, in order to prevent the proliferation of various molds and fungi that will proliferate in a hydrophilic colloid layer, to deteriorate an image, preferably mildew-proofing agents, as described in JP-A No. 271247/1988, are added.

When the light-sensitive material of the present invention is subjected to printer exposure, it is preferable to use a band stop filter described in U.S. Pat. No. 4,880,726, by which light color-mixing is removed, to noticeably improve color reproduction.

The exposed light-sensitive material can be subjected to conventional color development processing. After the color development, a desilvering process is carried out. In the desilvering process, a bleaching process and a fixing process may be carried out separately or simultaneously (a bleach-fix process). Preferably a mode of the desilvering process in the present invention comprises a bleach-fix process after color development, for the purpose of rapid processing. In particular when the above high-silver-chloride emulsion is used, preferably the pH of the bleaching solution is about 6.5 or less, more preferably about 6.0 or less, and further preferably about 5.5 or less, for the purpose, for example, of accelerating the desilvering. Further, to make the processing rapid, a processing method wherein, after a bleaching process, a bleach-fix process is carried out, may be used. Further, a process wherein use is made of bleach-fix solutions contained in two consecutive baths, a process wherein a fixing process is carried out before a bleach-fix process, or a process wherein a bleaching process is carried out after a bleach-fix process, can be carried out arbitrarily to meet an intended purpose.

Example bleaching agents for use in the bleaching solution or the bleach-fix solution include, for example, iron salts; compounds of polyvalent metals, such as iron(III), cobalt(III), chromium(IV), and copper(II); peracids; quinones; and nitro compounds. Typical bleaching agents are iron chloride, ferricyanides, dichromates, organic complex salts of iron(III) (e.g. metal complex salts of aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid, and glycol-ether-diaminetetraacetic acid), persulfates, bromates, permanganates, and nitrobenzenes. Among them, aminopolycarboxylic acid iron(III) complex salts, such as ethylenediaminetetraacetatic acid iron(III) complex salt and 1,3-diaminopropanetetraacetic acid iron(III) complex salt, are preferred, in view of rapid processing and the prevention of environmental pollution. Further, aminopolycarboxylic acid iron (III) complex salts are particularly useful in a bleaching solution and a bleach-fix solution. The bleaching solution and bleach-fix solution that use these aminopolycarboxylic acid irons(III) complex salts can be generally used at a pH of 3 to 8.

In the bleaching solution and the bleach-fix solution, use can be made of known additives, such as a rehalogenating agent, including ammonium bromide and ammonium chloride; a pH buffering agent, including ammonium nitrate; and a metal corrosion-preventive agent, including ammonium sulfate.

In the bleaching solution and the bleach-fix solution, besides the above-mentioned compounds, it is preferable to contain an organic acid, for the purpose of preventing bleach stain. The particularly preferable organic acid is a compound having an acid dissociation constant (pKa) of 2 to 5.5, and specifically acetic acid, and propionic acid are preferable.

Example fixing agents for use in the fixing solution and the bleach-fix solution include thiosulfates, thiocyanates, thioether-series compounds, thioureas, a large amount of iodide salts, and use of thiosulfates is usual, and especially ammonium thiosulfate is most widely used. A combination of thiosulfates with thiocyanates, thioether-series compounds, or thiourea, is also preferable.

Preferable preservatives for the fixing solution and the bleach-fix solution are sulfites, bisulfites, carbonylbisulfite adducts, and sulfinic acid compounds described in European Patent No. 294769A. Further, in the fixing solution and the bleach-fix solution, to stabilize the solutions, it is preferable to add any of various aminopolycarboxylic acids, organic phosphonic acids (e.g. 1-hydroxyethylidene-1,1-diphosphonic acid, N,N,N',N'-ethylenediaminetetraphosphonic acid).

In the fixing solution and the bleach-fix solution, further, for example, any of various fluorescent whitening agents, antifoaming agents, surface-active agents, polyvinylpyrolidones, and methanol can be contained.

In the bleaching solution, the bleach-fix solution, and the bath preceding them, if required, a bleach-accelerating agent can be used. Specific examples of useful bleach-accelerating agents include compounds having a mercapto group or a disulfide bond, as described, for example, in U.S. Pat. No. 3,893,856, West German Patent No. 1,290,812, JP-A No. 95630/1978, and Research Disclosure No. 17129 (July 1978); thiazolidine derivatives described in JP-A No. 140129/1975; thiourea derivatives described in U.S. Pat. No. 3,706,561; iodide salts described in JP-A No. 16235/1983; polyoxyethylene compounds described in West Germany Patent No. 2,748,430; polyamine compounds described in JP-B No. 8836/1970; and iodide ions. Above all, compounds having a mercapto group or a disulfide group are preferable, because they are high in accelerating effect, and specifically, compounds described in U.S. Patent No. 3,893,858, West Germany patent No. 1,290,812, and JP-A No. 95630/1978 are preferable. Further, compounds described in U.S. Patent No. 4,552,834 are preferable. These bleach-accelarating agent may be added in the light-sensitive material.

The shorter the total time of the bleach/fix process in the present invention is, the more preferable it is, as long as the shortening of the processing time does not cause defective desilvering. A preferable total time is 5 sec to 1 min, and more preferably 5 sec to 25 sec. Further, the processing temperature is generally 25° to 50° C. and preferably 35° to 45° C. Within the preferable range of the processing temperature, the desilvering rate is increased and the occurrence of stain after the processing can be effectively prevented.

Further, in the processing steps applied in the present invention, any known stirring method can be applied in each steps, and preferably the stirring is intensified as much as possible. To intensify the stirring, specifically a method wherein a jet stream of a processing liquid is caused to impinge on the emulsion surface of a light-sensitive material, as described in JP-A Nos. 183460/1987 and 183461/1987; a method wherein a rotating means is used to increase the stirring effect, as described in JP-A No. 183461/1987; a method wherein a light-sensitive material is moved, with the emulsion surface of the material being in contact with a wiper blade provided in a liquid, so that a turbulent flow may occur near the emulsion surface, to improve the stirring effect; and a method wherein the total amount of a processing solution to be circulated is increased, can be mentioned. These means of improving the stirring are useful in any of the developing solution, the bleaching solution, the bleach-fix solution, the fix solution, the washing liquid and/or the stabilizing solution.

As the silver halide emulsions, other materials (e.g. additives), and photographic constitutional layers (e.g. layer arrangement) that can be applied to the light-sensitive material according to the present invention; and, as the processing methods and the processing additives that can be applied for processing the light-sensitive material, those described in the below-mentioned patent gazettes, in particular, in the specification of European Patent No. 0,355,660 A2 (JP-A No. 139544/1987), are preferably used.

| Photographic constituting element, etc. | JP-A No. 215272/1987 | JP-A No. 33144/1990 | EP 0,355,660A2 |
|---|---|---|---|
| Silver halide emulsion | p.10 upper right column line 6 to p.12 lower left column line 5, and p.12 lower right column line 4 from the bottom to p.13 upper left column line 17 | p.28 upper right column line 16 to p.29 lower right column line 11 and p.30 lines 2 to 5 | p.45 line 53 to p.47 line 3 and p.47 lines 20 to 22 |
| Solvent for silver halide | p.12 lower left column line 6 to 14 and p.13 upper left column line 3 from the bottom to p.18 lower left column last line | — | — |
| Chemical sensitizer | p.12 lower left column line 3 from the bottom to lower right column line 5 from the bottom and p.18 lower right column line 1 to p.22 upper right column line 9 from the bottom | p.29 lower right column line 12 to last line | p.47 lines 4 to 9 |
| Spectral sensitizing agent (method) | p.22 upper right column line 8 from the bottom to p.38 last line | p.30 upper left column lines 1 to 13 | p.47 lines 10 to 15 |
| Emulsion stabilizer | p.39 upper left column line 1 to p.72 upper right column last line | p.30 upper left column line 14 to upper right column line 1 | p.47 lines 16 to 19 |
| Developing accelerator | p.72 lower left column line 1 to p.91 upper right column line 3 | — | — |
| Color coupler (Cyan, Magenta, and Yellow coupler) | p.91 upper right column line 4 to p.121 upper left column line 6 | p.3 upper right column line 14 to p.18 upper left column last line and p.30 upper right column line 6 to p.35 lower right column line 11 | p.4 lines 15 to 27, p.5 line 30 to p.28 last line, p.45 lines 29 to 31 and p.47 line 23 to p.63 line 50 |
| Color Formation-strengthening agent | p.121 upper left column line 7 to p.125 upper right column line 1 | — | — |
| Ultraviolet absorbing agent | p.125 upper right column line 2 to p.127 lower left column last line | p.37 lower right column line 14 to p.38 upper left column line 11 | p.65 lines 22 to 31 |
| Discoloration inhibitor (Image stabilizer) | p.127 lower right column line 1 to p.137 lower left column line 8 | p.36 upper right column line 12 to p.37 upper left column line 19 | p.4 line 30 to p.5 line 23, p.29 line 1 to p.45 line 25 p.45 lines 33 to 40 and p.65 lines 2 to 21 |
| High-boiling and/or low-boiling organic solvent | p.137 lower left column line 9 to p.144 upper right column last line | p.35 lower right column line 14 to p.36 upper left column line 4 from the bottom | p.64 lines 1 to 51 |
| Method for dispersing additives for photograph | p.144 lower left column line 1 to p.146 upper right column line 7 | p.27 lower right column line 10 to p.28 upper left column last line and p.35 lower right column line 12 to p.36 upper right column line 7 | p.63 line 51 to p.64 line 56 |
| Film Hardener | p.146 upper right column line 8 to p.155 lower left column line 4 | — | — |
| Developing agent precursor | p.155 lower left column line 5 to p.155 lower right column line 2 | — | — |

-continued

| Photographic constituting element, etc. | JP-A No. 215272/1987 | JP-A No. 33144/1990 | EP 0,355,660A2 |
|---|---|---|---|
| Compound releasing development inhibitor | p.155 lower right column lines 3 to 9 | — | — |
| Base | p.155 lower right column line 19 to p.156 upper left column line 14 | p.38 upper right column line 18 to p.39 upper left column line 3 | p.66 line 29 to p.67 line 13 |
| Constitution of photosensitive layers | p.156 upper left column line 15 to p.156 lower right column line 14 | p.28 upper right column lines 1 to 15 | p.45 lines 41 to 52 |
| Dye | p.156 lower right column line 15 to p.184 lower right column last line | p.38 upper left column line 12 to upper right column line 7 | p.66 lines 18 to 22 |
| Color-mix inhibitor | p.185 upper left column line 1 to p.188 lower right column line 3 | p.36 upper right column lines 8 to 11 | p.64 line 57 to p.65 line 1 |
| Gradation controller | p.188 lower right column lines 4 to 8 | — | — |
| Stain inhibitor | p.188 lower right column line 9 to p.193 lower right column line 10 | p.37 upper left column last line to lower right column line 13 | p.65 line 32 to p.66 line 17 |
| Surface-active agent | p.201 lower left column line 1 to p.210 upper right column last line | p.18 upper right column line 1 to p.24 lower right column last line and p.27 lower left column line 10 from the bottom to lower right column line 9 | — |
| Fluorine-containing agent (As Antistatic agent, coating aid, lubricant, adhesion inhibitor, or the like) | p.210 lower left column line 1 to p.222 lower left column line 5 | p.25 upper left column line 1 to p.27 lower right column line 9 | — |
| Binder (Hydrophilic colloid) | p.222 lower left column line 6 to p.225 upper left column last line | p.38 upper right column lines 8 to 18 | p.66 lines 23 to 28 |
| Thickening agent | p.225 upper right column line 1 to p.227 upper right column line 2 | — | — |
| Antistatic agent | p.227 upper right column line 3 to p.230 upper left column line 1 | — | — |
| Polymer latex | p.230 upper left column line 2 to p.239 last line | — | — |
| Matting agent | p.240 upper left column line 1 to p.240 upper right column last line | — | — |
| Photographic processing method (processing process, additive, etc.) | p.3 upper right column line 7 to p.10 upper right column line 5 | p.39 upper left column line 4 to p.42 upper left column last line | p.67 line 14 to p.69 line 28 |

Note: In the cited part of JP-A No. 215272/1987, the contents of the descriptions in the amendment dated March 16, 1987, which appear in the last of the gazette, are included.

Preferably a cyan coupler, a magenta coupler, or a yellow coupler is impregnated into a loadable latex polymer (e.g. those described in U.S. Patent No. 4,203,716) in the presence (or absence) of a high-boiling point organic solvent listed in the above-mentioned Table, or such a coupler is dissolved together with a water-insoluble organic-solvent-soluble polymer and is emulsified and dispersed in an aqueous hydrophilic colloid solution.

Water-insoluble organic-solvent-soluble polymers that can be preferably used include homopolymers or copolymers described in U.S. Pat. No. 4,857,449, columns 7 to 15, and International Publication No. WO 88/00723, pages 12 to 30. More preferably, water-insoluble organic-solvent-soluble polymers are methacrylate-series or acrylamide-series polymers, and particularly use of acrylamide-series polymers is preferable, in view of dye image stability or the like.

In the light-sensitive material according to the present invention, preferably use is made of a dye-image-preservability-improving compound, as described in the specification of European Patent No. 0,277,589A2, together with a coupler. Particularly preferably such a compound is used together with a pyrazoloazole coupler, a pyrrolotriazole coupler, or a yellow coupler.

That is, preferably compounds that will combine chemically with the aromatic amine developing agent remaining after color development processing, to produce a chemically inert and substantially colorless compound, as described in the specification of the said European Patent, and/or compounds that will combine chemically with the oxidation product of the aromatic amine developing agent remaining after color development processing, to produce a chemically inert and substantially colorless compound, as described in the specification of the said European Patent, are used in combination or alone. This is because, by using these compounds, for example, occurrence of stain or other side effects, due to the production of a color-formed dye resulting from reaction of the coupler with the color developing agent or its oxidation product remaining in the film during storage after the processing, can be prevented.

As magenta couplers to be used in the present invention, 5-pyrazolone-series magenta couplers and pyrazoloazole-type couplers, as described in the gazettes in the above table, can be mentioned. As 5-pyrazolone-series magenta couplers, 5-pyrazolone-series magenta couplers of arylthio coupling split-off, described in International Publication WO Nos. 92/18901, 92/18902, and 92/18903, are preferable, because of the image preservability and less fluctuation of the image quality after processing.

Further, as pyrazoloazole-series couplers, pyrazolotriazole couplers in which a secondary or tertiary alkyl group is directly bonded to the 2-, 3-, or 6-position of the pyrazolotriazole ring, as described in JP-A No. 65245/1986; pyrazoloazole couplers containing a sulfonamide group in the molecule, as described in JP-A No. 65246/1986; pyrazoloazole couplers having an alkoxyphenylsulfonamido ballasting group, as described in JP-A No. 147254/1986; and pyrazoloazole couplers having an alkoxy group or an aryloxy group in the 6-position, as described in European Patent Nos. 226,849A and 294,785A, are preferably used in view, for example, of the hue, the image stability, and the color-forming property.

As yellow couplers used in the present invention, known acylacetanilide-type couplers are preferably used, and above all, pivaloylacetanilide-type couplers having a halogen atom or an alkoxy group in the ortho-position of the anilide ring; acylacetanilide-type couplers in which the acyl group is a 1-position-substituted cycloalkanecarbonyl group, which are described, for example, in European Patent No. 0,447,969A, JP-A Nos. 107701/1993, and 113642/1993; and malondianilide-type couplers described, for example, in European Patent Nos. 0,482,552A and 0,524,540A, are preferably used.

As the method of processing the color light-sensitive material of the present invention, besides the methods described in the above patent gazette, processing materials and processing methods described in JP-A No. 207250/1990, page 26, right lower column, line 1, to page 34, upper right column, line 9; and in JP-A No. 97355/1992, page 5, upper left column, line 17 to page 18, lower right column, line 20, are preferable.

The color photographic light-sensitive material of the present invention is excellent in rapid processibility; it is not substantially subject to blix fading, which will result from a decrease in the color density due to the leuco dye formation of a produced cyan dye in a blix solution; and it is capable of forming a color photograph excellent in image quality, high in color density, and free from destruction of the color balance of the image with the lapse of time after processing.

EXAMPLES

Now, the present invention will be described in more detail with reference to Example, but the present invention is not limited to them.

Example 1

A paper base, both surfaces of which had been laminated with polyethylene, was subjected to surface corona discharge treatment; then it was provided with a gelatin undercoat layer containing sodium dodecylbenzenesulfonate, and it was coated with various photographic constitutional layers, to produce a multi-layer photographic color printing paper (101) having the layer constitution shown below.

(Manufacturing of a Light-sensitive material 101)

On the above-described reflective base, various photographic constitutional layers were coated, to produce a multi-layer photographic color printing paper (101) having the layer constitution shown below. The coating liquids were prepared as follows.

Preparation of the Fifth-Layer Coating Liquid 88.8 g of a cyan coupler (ExC), 28.8 g of Ultraviolet Absorbing Agent (UV-B), 25.2 g of a color image stabilizer (Cpd-1), 1.2 g of a color image stabilizer (Cpd-6), 1.2 g of a color image stabilizer (Cpd-8), 1.2 g of a color image stabilizer (Cpd-9), and 1.3 g of a color image stabilizer (Cpd-10) were dissolved in 1.3 g of a solvent (Solv-1), 24 g of a solvent (Solv-6), and 180 ml of ethyl acetate, and the resulting solution was emulsified and dispersed into 800 g of a 10% aqueous gelatin solution containing 60 ml of 10% sodium dodecylbenzenesulfonate, to prepare an emulsified dispersion C. On the other hand, a silver chlorobromide emulsion C (cubes, a mixture of a large-size emulsion C having an average grain size of 0.50 $\mu$m, and a small-size emulsion C having an average grain size of 0.41 $\mu$m (1:4 in terms of mol of silver), the deviation coefficients of the grain size distributions being 0.09 and 0.11, respectively, and each emulsion having 0.8 mol % of silver bromide locally contained in part of the grain surface whose substrate was made up of silver chloride) was prepared. To the large-size emulsion C of this emulsion, were added $5.0\times10^{-5}$ mol, per mol of silver, of each of red-sensitive sensitizing dyes G and H shown below, and to the small-size emulsion C of this emulsion, were added $8.0\times10^{-5}$ mol, per mol of silver, of each of red-sensitive sensitizing dyes G and H shown below. Further, $2.6\times10^{-3}$ mol, per mol of silver halide, of an additive X was added. The chemical ripening of this emulsion was optimally carried out with a sulfur sensitizer and a gold sensitizer being added. The above emulsified dispersion C and this silver chlorobromide emulsion C were mixed and dissolved, and a fifth-layer coating liquid was prepared so that it would have the composition shown below. The coating amount of the emulsion is in terms of silver.

In the similar way as the method of preparing the fifth-layer coating liquid, coating liquids for the other layers were prepared. As the gelatin hardeners for each layers, 1-oxy-3, 5-dichloro-s-triazine sodium salt was used.

Further, to each layer, were added Cpd-12, Cpd-13, Cpd-14, and Cpd-15, so that the total amounts would be 15.0 mg/m$^2$, 60.0 mg/m$^2$, 5.0 mg/m$^2$, and 10.0 mg/m$^2$ respectively.

For the silver chlorobromide emulsion of each photosensitive emulsion layer, the following spectral sensitizing dyes were used.

Blue-Sensitive Emulsion Layer

Sensitizing dye A

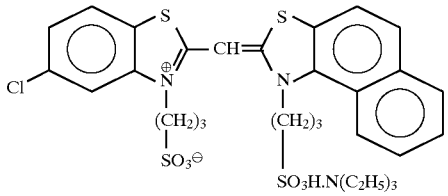

-continued

Sensitizing dye B

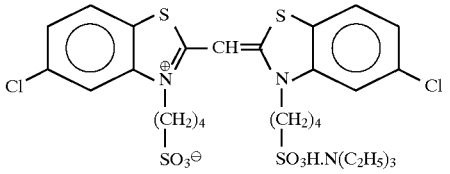

Sensitizing dye C

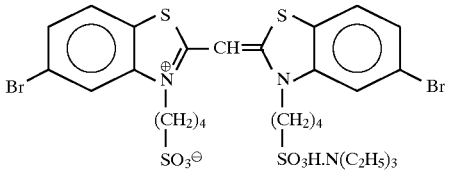

(Each was added to the large-size emulsion in an amount of $1.4\times10^{-4}$ mol per mol of the silver halide, and to the small-size emulsion in an amount of $1.7\times10^{-4}$ mol per mol of the silver halide.)

Green-Sensitive Emulsion Layer

Sensitizing dye D

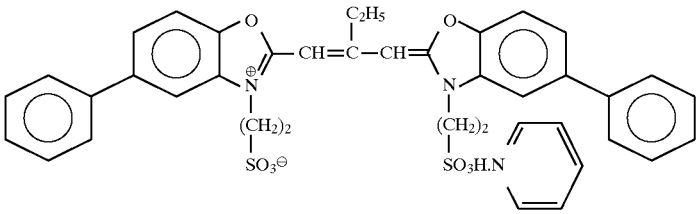

Sensitizing dye E

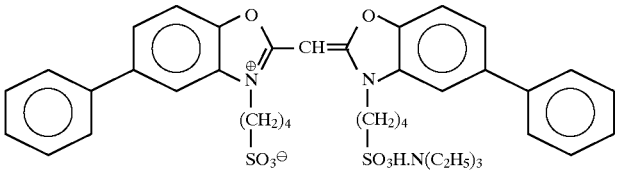

Sensitizing dye F

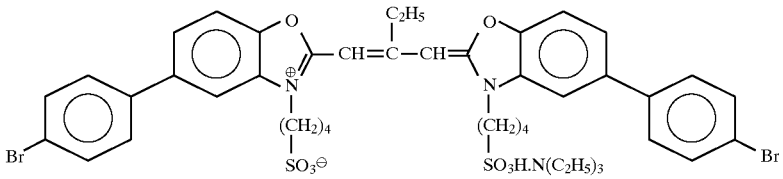

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

Red-Sensitive Emulsion Layer

Sensitizing dye G

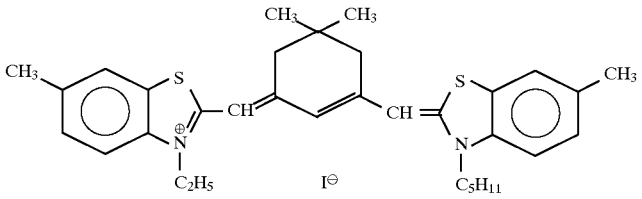

Sensitizing dye H

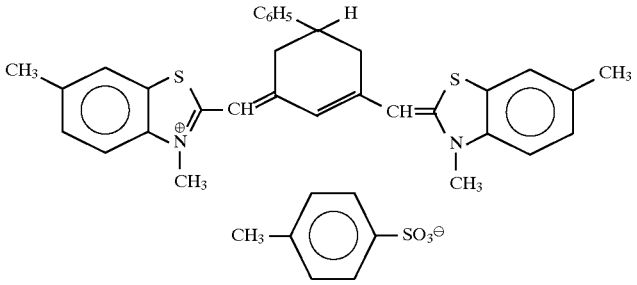

(Each was added to the large-size emulsion in an amount of $5.0\times10^{-5}$ mol per mol of the silver halide, and to the small-size emulsion in an amount of $8.0\times10^{-5}$ mol per mol of the silver halide.)

Further, the following additive X was added in an amount of $2.6\times10^{-3}$ mol per mol of the silver halide.

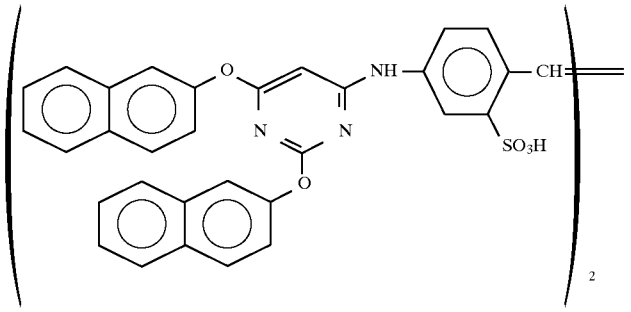

To the blue-sensitive emulsion layer, the green-sensitive emulsion layer, and the red-sensitive emulsion layer, was added 1-(5-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the fourth layer, the sixth layer, and the seventh layer, were added the same compound, so that the amounts would be 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, as a water-soluble dye preventing irradiation, the following compound was added to the sixth layer.

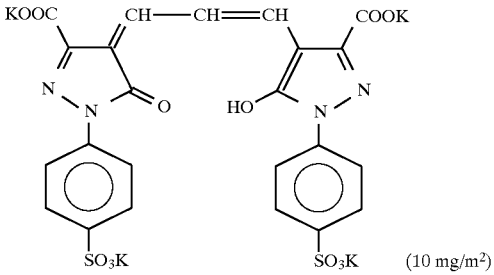

(10 mg/m$^2$)

and

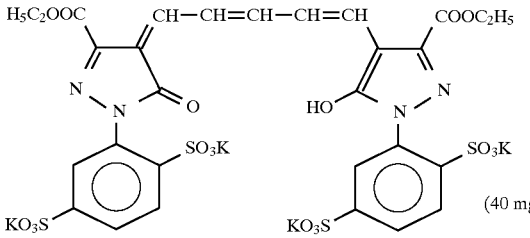

(40 mg/m$^2$)

(Layer Constitution)

The composition of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a white pigment ($TiO_2$; in a content of 15% by weight) and a blue dye (ultramarine)]

First Layer (Blue-Sensitive Emulsion Layer)

Silver chlorobromide emulsion A (cubes, a mixture of a large-size emulsion A having an average grain size of 0.88 μm, and a small-size emulsion A having an average grain size of 0.70 μm (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride)

| | |
|---|---|
| | 0.25 |
| Gelatin | 1.38 |
| Yellow coupler (ExY) | 0.60 |
| Color image stabilizer (Cpd-1) | 0.08 |
| Color image stabilizer (Cpd-2) | 0.04 |
| Color image stabilizer (Cpd-3) | 0.08 |
| Color image stabilizer (Cpd-5) | 0.02 |
| Solvent (Solv-1) | 0.22 |
| Second Layer (Color Mixing Inhibiting Layer) | |
| Gelatin | 1.01 |
| Color mixing inhibitor (Cpd-4) | 0.11 |

-continued

| | |
|---|---|
| Solvent (Solv-1) | 0.07 |
| Solvent (Solv-2) | 0.20 |
| Solvent (Solv-3) | 0.15 |
| Solvent (Solv-7) | 0.12 |
| Color image stabilizer (Cpd-7) | 0.10 |

Third Layer (Green-Sensitive Emulsion Layer)

A silver chlorobromide emulsion (cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.8 mol % of AgBr contained locally in part of the grain surface whose substrate was made up of silver chloride.)

| | |
|---|---|
| | 0.13 |
| Gelatin | 1.45 |
| Magenta coupler (ExM) | 0.13 |
| Ultraviolet absorbing agent (UV-A) | 0.12 |
| Color image stabilizer (Cpd-2) | 0.01 |
| Color image stabilizer (Cpd-5) | 0.02 |
| Color image stabilizer (Cpd-6) | 0.01 |
| Color image stabilizer (Cpd-7) | 0.08 |
| Color image stabilizer (Cpd-8) | 0.03 |
| Color image stabilizer (Cpd-9) | 0.01 |
| Solvent (Solv-4) | 0.22 |
| Solvent (Solv-5) | 0.11 |
| Solvent (Solv-8) | 0.15 |
| Fourth Layer (Color Mixing Inhibiting Layer) | |
| Gelatin | 0.73 |
| Color mixing inhibitor (Cpd-4) | 0.08 |
| Solvent (Solv-1) | 0.05 |
| Solvent (Solv-2) | 0.15 |
| Solvent (Solv-3) | 0.12 |
| Solvent (Solv-7) | 0.09 |
| Color image stabilizer (Cpd-7) | 0.07 |

Fifth Layer (Red-Sensitive Emulsion Layer)

A silver chlorobromide emulsion (cubes, a mixture of a large-size emulsion having an average grain size of 0.50 μm, and a small-size emulsion having an average grain size of 0.41 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride.)

| | |
|---|---|
| | 0.19 |
| Gelatin | 0.74 |
| Cyan coupler (ExC) | 0.24 |
| Ultraviolet absorbing agent (UV-B) | 0.21 |
| Color image stabilizer (Cpd-1) | 0.20 |
| Color image stabilizer (Cpd-6) | 0.01 |
| Color image stabilizer (Cpd-8) | 0.01 |
| Color image stabilizer (Cpd-9) | 0.01 |
| Color image stabilizer (Cpd-10) | 0.01 |
| Solvent (Solv-1) | 0.01 |
| Solvent (Solv-6) | 0.20 |
| Sixth Layer (Ultraviolet Absorbing Layer) | |
| Gelatin | 0.73 |
| Ultraviolet absorbing agent (UV-C) | 0.34 |
| Color image stabilizer (Cpd-7) | 0.05 |
| Solvent (Solv-9) | 0.40 |
| Seventh Layer (Protective Layer) | |
| Gelatin | 1.01 |
| Acryl-modified copolymer of polyvinyl alcohol (modification degree: 17%) | 0.04 |

-continued
| | |
|---|---|
| Liquid paraffin | 0.02 |
| Color image stabilizer (Cpd-15) | 0.01 |
(ExY) Yellow coupler
(ExY-1)
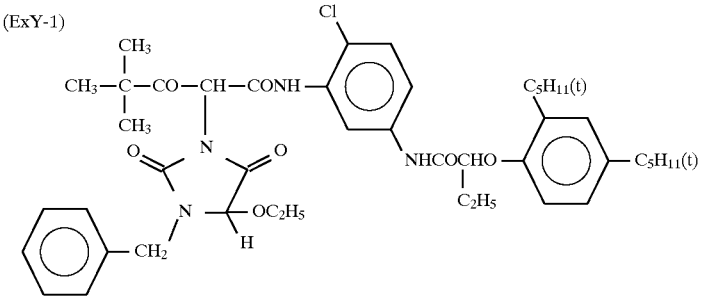
(ExY-2)
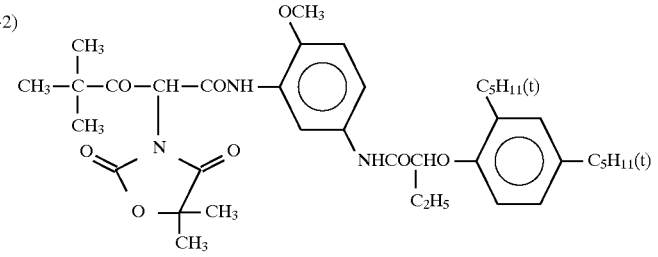
(ExY-3)
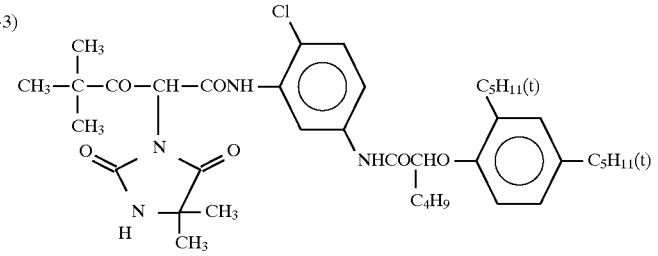
Mixture in a molar ratio of 1:1:1
(ExM) Magenta coupler
(ExM-1)
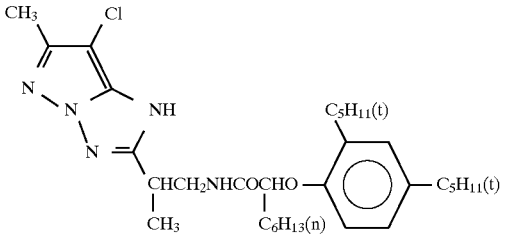
(ExM-2)
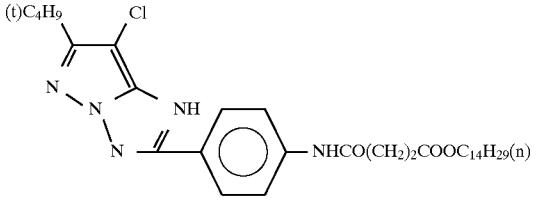
(Mixture in a molar ratio of 1:5)

-continued
(ExC) Cyan coupler
(ExC-1)
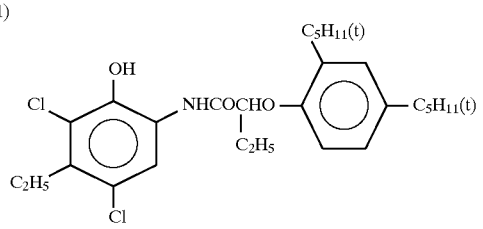
(ExC-2)
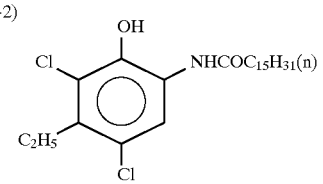
(ExC-1)/(ExC-2) = 15/85 (molar ratio)
(Cpd-1) Color-image stabilizer
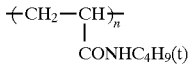
Average molecular weight of 60,000
(Cpd-2) Color-image stabilizer
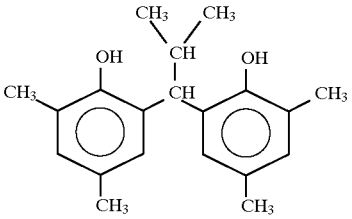
(Cpd-3) Color-image stabilizer
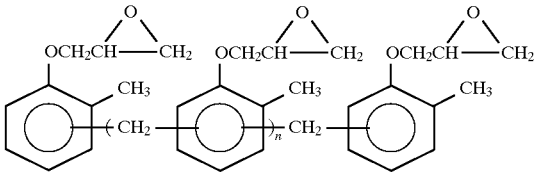
n = 7 ~ 8
(average value)
(Cpd-4) Color-mixing inhibitor
Mixture in 1:1:1 (weight ratio) of
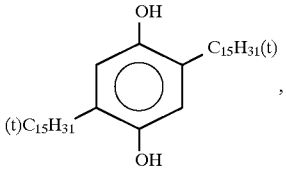
,
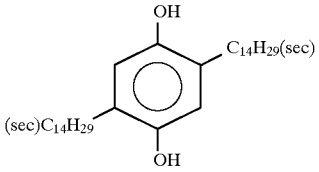
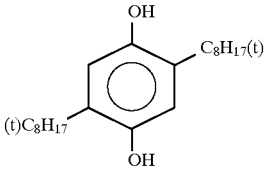
(Cpd-5) Color-image stabilizer
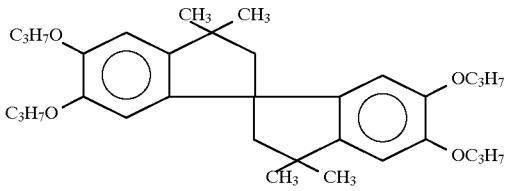

-continued (Cpd-6) Color-image stabilizer

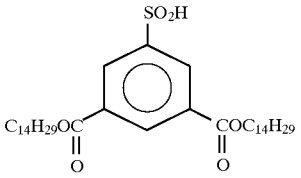

(Cpd-7) Color-image stabilizer

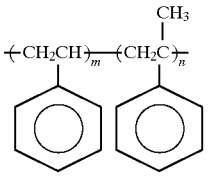

number average
molecular weight of 600
m/n = 10/90

(Cpd-8) Color-image stabilizer

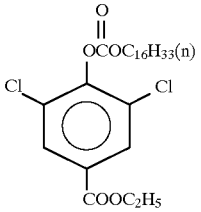

(Cpd-9) Color-image stabilizer

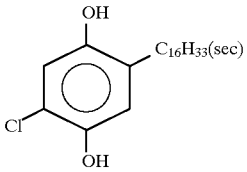

(Cpd-10) Color-image stabilizer

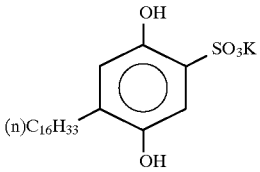

(Cpd-11) Surface-active agent
Mixture in 7:3 (weight ratio) of

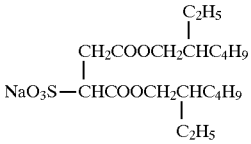

and

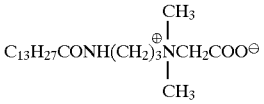

(Cpd-12) Antiseptic

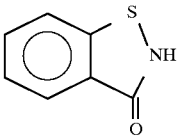

(Cpd-13) Antiseptic

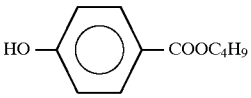

(Cpd-14) Antiseptic
Mixture in 1:1:1:1 (weight ratio) of a, b, c and d

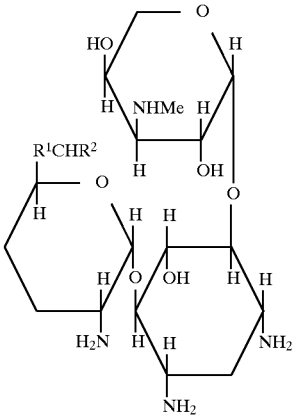

| | $R^1$ | $R^2$ |
|---|---|---|
| a | —Me | —NHMe |
| b | —Me | —$NH_2$ |
| c | —H | —$NH_2$ |
| d | —H | —NHMe |

(Cpd-15) Antiseptic

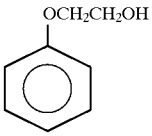

-continued
(Solv-1) Solvent
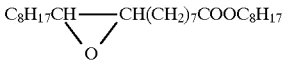
(Solv-2) Solvent
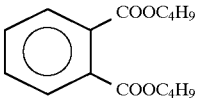
(Solv-3) Solvent
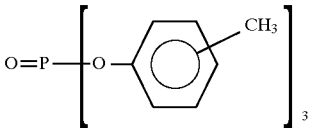
(Solv-4) Solvent
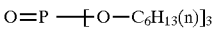
(Solv-5) Solvent
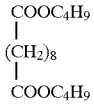
(Solv-6) Solvent
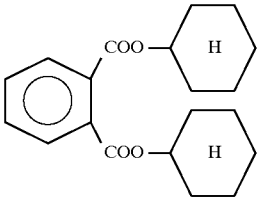
(Solv-7) Solvent
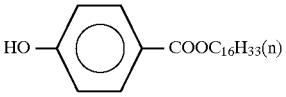
(Solv-8) Solvent
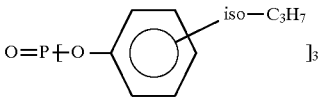
(Solv-9) Solvent
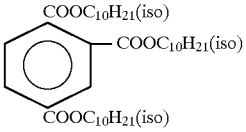
(UV-A) Ultra-violet absorbent
(1)
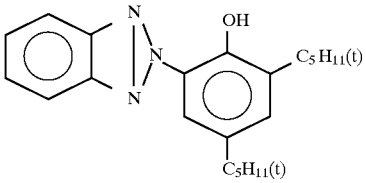
(2)
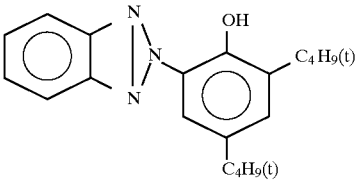
(3)
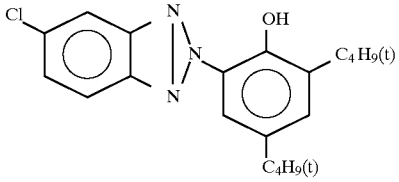
(4)
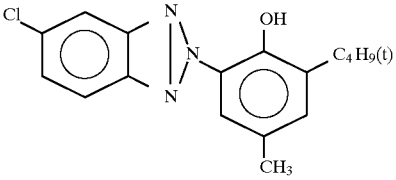
Mixture in 4:3:2:2 (weight ratio) of (1), (2), (3) and (4)
(UV-B) Ultra-violet absorbent
(1)
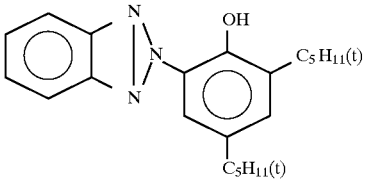
(2)
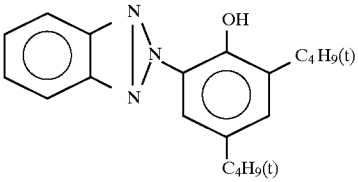

-continued (3)

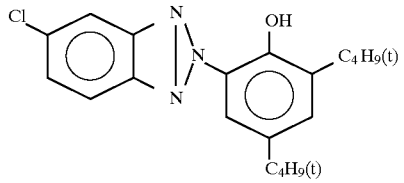

(4)

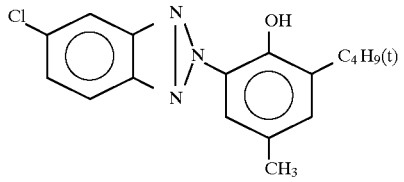

Mixture in 5:2:2:2 (weight ratio) of (1), (2), (3) and (4)

(UV-C) Ultra-violet absorbent (1)

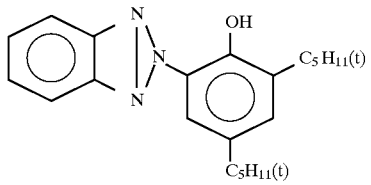

(2)

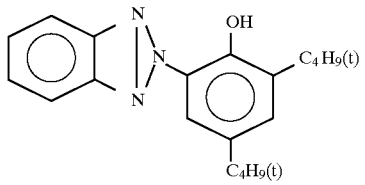

(3)

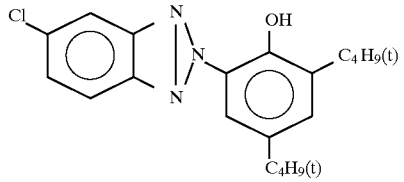

(4)

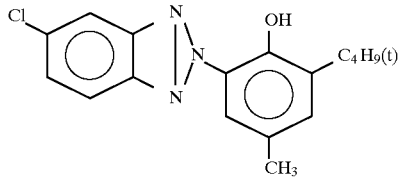

(5)

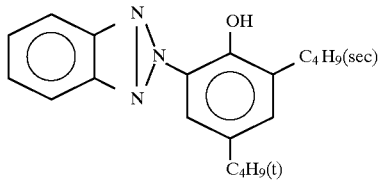

Mixture in 6:2:2:2:3 (weight ratio) of (1), (2), (3), (4) and (5)

In addition to the thus prepared light-sensitive material 101, as shown in Table 2, light-sensitive materials 102 to 119 were prepared with the same method to the light-sensitive material 101, except that the cyan coupler and a polymer were used as shown in Table 2 in the fifth red-sensitive layer. The molecular weight of the used polymer according to the present invention was 100,000 to 500,000, in terms of weight average molecular weight. The ratio of polymer to be used was 30% by weight of the coupler.

After, the above light-sensitive materials were subjected to image-wise exposure to light, they were processed continuously using a paper processor in the following processing steps.

| Processing step | Temperature | Time | Replenisher* | Tank volume |
|---|---|---|---|---|
| Color Development | 38.5° C. | 45 sec | 73 ml | 500 ml |
| Bleach-fix | 30–35° C. | 45 sec | 60 ml | 500 ml |
| Rinse (1) | 30–35° C. | 20 sec | — | 500 ml |
| Rinse (2) | 30–35° C. | 20 sec | — | 500 ml |
| Rinse (3) | 30–35° C. | 20 sec | 370 ml | 500 ml |

-continued

| Processing step | Temperature | Time | Replenisher* | Tank volume |
|---|---|---|---|---|
| Drying | 70–80° C. | 60 sec | | |

*Replenishing amount per $m^2$ of the light-sensitive material (Rinsing was conducted in a three tanks counter current system from (3) to (1).)

The composition of each processing solution are as follows.

Color Developer

| | Tank liquid | Replenisher |
|---|---|---|
| Water | 700 ml | 700 ml |
| Sodium triisopropylene (β) sulfonate | 0.1 g | 0.1 g |
| Ethylenediaminetetraacetic acid | 3.0 g | 3.0 g |
| 1,2-Dihydroxybenzene-4,6-disulfonic acid disodium salt | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Whitening agent (WHITEX 4, trade | 1.0 g | 3.0 g |

-continued

| | | |
|---|---|---|
| name: manufactured by Sumitomo Kagaku Co.) | | |
| Sodium sulfite | 0.1 g | 0.1 g |
| Disodium N,N-bis(sulfonatoethyl)-hydroxylamine | 10.0 g | 13.0 g |
| N-ethyl-N-(β-methanesulfonamido-ethyl)-3-methyl-4-aminoaniline sulfate | 5.0 g | 11.5 g |
| Water to make | 1,000 ml | 1,000 ml |
| pH (at 25° C.) | 10.0 | 11.0 |

| Bleach-fix Liquid (both the tank liquid and replenisher were the same) | |
|---|---|
| Water | 600 ml |
| Ammonium thiosulfate (700 g/liter) | 100 ml |
| Ammonium sulfite | 40 g |
| Ethylenediaminetetraacetic acid iron(III) ammonium salt | 55 g |
| Disodium ethylenediaminetetraacetate | 5 g |
| Ammonium bromide | 40 g |
| Nitric acid (67%) | 30 g |
| Water to make | 1,000 ml |
| pH (at 25° C., adjusted with acetic acid and aqueous ammonia) | 4.8 |

Rinse Liquid (both the tank liquid and replenisher were the same).

Deionized water (calcium and magnesium were respectively 3 ppm or less.)

After image-wise exposure, the light-sensitive material samples 101 to 119 were processed in the above processing steps.

Immediately after the processing, the cyan reflection density ($D_A$) of the $D_{max}$ part of each sample was measured; then, after the sample was dipped in a bleaching solution for color negative film, CN-16N2X (trade name, manufactured by Fuji Photo Film Co., Ltd.; described in a manual for CN-16X), for 30 min, to cause the leuco dye of the cyan dye partially formed during the above processing to be restored to the cyan dye (color-restoration), the cyan reflection density ($D_B$) of the $D_{max}$ part was measured again. The measured $D_B$ for each sample was approximately 2.5.

From these respective densities, immediately after the processing and after restoring the leuco dye to the cyan dye, the extent of the leuco dye formation (blix fading) of the cyan dye was taken as the cyan density decrease rate, which was expressed by the following equation:

$$\text{Cyan density decrease rate}=(1-D_A/D_B)\times 100$$

As is apparent from the results shown in Table 2, it can be understood that, according to the present invention, even immediately after the processing, a leuco dye of the cyan dye was not substantially formed, and an image high in maximum density could be obtained, while in the comparative samples, immediately after the processing, a leuco dye was produced and the maximum density was deteriorated.

TABLE 2

| Sample | Polymer | Cyan density decrease rate (%) | Remarks |
|---|---|---|---|
| 101 | — | 14 | Comparison |
| 102 | P-1 | 5 | This invention |
| 103 | P-2 | 3 | This invention |
| 104 | P-3 | 2 | This invention |
| 105 | P-4 | 3 | This invention |
| 106 | P-7 | 3 | This invention |

TABLE 2-continued

| Sample | Polymer | Cyan density decrease rate (%) | Remarks |
|---|---|---|---|
| 107 | P-10 | 3 | This invention |
| 108 | P-13 | 4 | This invention |
| 109 | P-17 | 4 | This invention |
| 110 | P-15 | 4 | This invention |
| 111 | P-22 | 3 | This invention |
| 112 | P-29 | 4 | This invention |
| 113 | P-37 | 4 | This invention |
| 114 | Comparative polymer a | 15 | Comparison |
| 115 | Comparative polymer b | 12 | Comparison |
| 116 | Comparative polymer c | 17 | Comparison |
| 117 | Comparative polymer d | 19 | Comparison |
| 118 | Comparative polymer e | 20 | Comparison |
| 119 | Comparative polymer f | 16 | Comparison |

Comparative polymer a
n-Butyl acrylate (latex: water-insoluble)
Comparative polymer b
Methacrylic acid/n-butyl acrylate copolymer (10/90)
M = H/Na (0/100)
Comparative polymer c
Methacrylic acid/n-butyl acrylate copolymer (90/10)
M = H/Na (20/80)
Comparative polymer d
Methacrylic acid homopolymer M = H/Na (20/80)
Comparative polymer e
Acrylic acid homopolymer M = H/Na (0/100)
Comparative polymer f
Ethyl acrylate (latex: water-insoluble)

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material having at least one silver halide emulsion layer on a base, wherein the said silver halide emulsion layer contains silver halide grains having a silver chloride content of 90 mol % or more and at least one cyan dye-forming coupler and a polymer represented by formula [I]:

$$-(A)_x-(B)_y- \qquad \text{formula [I]}$$

wherein A represents a repeating unit derived from at least one selected from the group consisting of an acrylic acid, a methacrylic acid, an itaconic acid, a crotonic acid, a maleic acid, an N-(carboxymethyl)acrylamide, an N-(3-carboxypropyl)methacrylamide, an N-(5-carboxypentyl) acrylamide, an N-(5-carboxypentyl)methacrylamide an N-(10-carboxydecyl)acrylamide, an N-(1-carboxy-2-pheneylethyl)methacrylamide, an N-(α-carboxybenzyl) acrylamide, a p-carboxystyrene, a 2-(2-carboxyethylcarbonyloxy)ethyl acrylate, a 2-(o-carboxybenzoyloxy)ethyl acrylate, a 2-(o-carboxybenzoyloxy)ethyl methacrylate, a 2(2,4-dicarboxybenzoyloxy)ethyl acrylate, a 2-(2,4-dicarboxybenzoyloxy)ethyl methacrylate, a 4-vinylbenzoyloxyacetic acid, an N-(4-carboxyphenyl) acrylamide an N-(4-carboxyphenyl)methacrylamide, an N-(2-carboxyphenyl)acrylamide, an N-(2-carboxyphenyl) methacrylamide, an α-carboxy-benzyl acrylate, a 1-carboxyethyl methacrylate, and an α-carboxy-benzyl methacrylate, B represents a repeating unit derived from at least one selected from the group consisting of acrylates, methacrylates, vinyl esters, acrylamides, methacrylamides, olefins, styrenes, vinyl ethers, crotonates, itaconates, maleates, fumarates, vinyl ketones, glycidyl acrylate, glycidyl methacrylate, acrylonitrile, methacrylonitrile, methylenemalonitrile, and vinylidene chloride, and x and y are 15 to 85 and 85 to 15, respectively, in terms of weight percentages of A and B, provided that x+y=100, and wherein the polymer is a water-soluble polymer that can be dissolved in an amount of 1 g or more per 100 g of water at 25° C.

2. The silver halide color photographic light-sensitive material as claimed in claim 1, wherein the base is a reflective support.

3. A silver halide color photographic light-sensitive material having at least one silver halide emulsion layer on a base, wherein the said silver halide emulsion layer contains silver halide grains having a silver chloride content of 90 mol % or more and at least one cyan dye-forming coupler and a polymer represented by formula [II]:

formula [II]

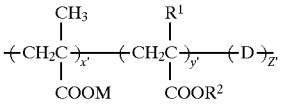

wherein M represents a hydrogen atom or a cation atom, $R^1$ represents a hydrogen atom or a methyl group, $R^2$ represents an alkyl group having 1 to 10 carbon atoms, D represents another ethylenically unsaturated monomer, x', y', and z' are 20 to 80, 80 to 20, and 0 to 30, respectively, in terms of weight percentages of the respective components, provided that x'+y'+z'=100, and wherein the polymer is a water-soluble polymer that can be dissolved in an amount of 1 g or more per 100 g of water at 25° C.

4. The silver halide color photographic light-sensitive material as claimed in claim 3, wherein the polymer represented by formula [II] is a methacrylic acid/n-butyl acrylate copolymer.

5. The silver halide color photographic light-sensitive material as claimed in claim 4, wherein the copolymerization degree of the methacrylic acid monomer to the n-butyl acrylate monomer is in the range of (60:40) to (40:60) in weight ratio.

6. The silver halide color photographic light-sensitive material as claimed in claim 1, wherein the repeating unit represented by A is derived from an acrylic acid, a methacrylic acid, an N-(carboxymethyl)-acrylamide, an N-(5-carboxypentyl)acrylamide, an N-(10-carboxydecyl) acrylamide, a p-carboxystyrene, a 2-(o-carboxybenzoyloxy) ethyl acrylate, or an N-(2-carboxyphenyl)acrylamide.

7. The silver halide color photographic light-sensitive material as claimed in claim 1, wherein the repeating unit represented by B further comprises a repeating unit derived from a monomer having an anionic group other than the —COOM represented by A, the anionic group being selected from the group consisting of a sulfonic acid group and a sulfate group.

8. The silver halide color photographic light-sensitive material as claimed in claim 1, wherein the repeating unit represented by B is derived from an acrylate or a methacrylate.

9. The silver halide color photographic light-sensitive material as claimed in claim 1, wherein the repeating unit represented by A is derived from a monomer being capable of forming a water-soluble homopolymer, and wherein the repeating unit represented by B is derived from a monomer being capable of forming a water-insoluble homopolymer.

10. The silver halide color photographic light-sensitive material as claimed in claim 1, wherein the molecular weight of the polymer is in the range of $5\times10^3$ to $1\times10^7$.

11. The silver halide color photographic light-sensitive material as claimed in claim 1, wherein the neutralization degree of the —COOM component in the polymer is in the range of 20 to 100%.

12. The silver halide color photographic light-sensitive material as claimed in claim 2, wherein the reflective support is a paper support, both surfaces of the paper support being coated with a water-resistant resin layer, and at least one of the water-resistant resin layer containing fine particles of a white pigment.

13. The silver halide color photographic light-sensitive material as claimed in claim 1, wherein the silver halide emulsion layer containing therein the said polymer is a water-soluble colloid layer formed with a water-soluble colloid, the weight ratio of the polymer to the water-soluble colloid being in the range of 0.02 to 0.30.

14. The silver halide color photographic light-sensitive material as claimed in claim 1, wherein the cyan dye-forming coupler is a phenol-series, naphthol-series, or pyrrolotriazole-series cyan coupler.

15. The silver halide color photographic light-sensitive material as claimed in claim 1, which further has at least one yellow color-forming silver halide emulsion layer, and at least one magenta color-forming silver halide emulsion layer, on the base.

* * * * *